US010544655B2

(12) United States Patent
Churchill

(10) Patent No.: US 10,544,655 B2
(45) Date of Patent: Jan. 28, 2020

(54) METHOD AND APPARATUS FOR SEVERING A DRILL STRING

(71) Applicant: Churchill Drilling Tools Limited, Aberdeen (GB)

(72) Inventor: Andrew Philip Churchill, Aberdeen (GB)

(73) Assignee: Churchill Drilling Tools Limited, Aberdeen (GB)

( * ) Notice: Subject to any disclaimer, the term of this patent is extended or adjusted under 35 U.S.C. 154(b) by 492 days.

(21) Appl. No.: 15/304,374

(22) PCT Filed: Apr. 17, 2015

(86) PCT No.: PCT/GB2015/051160
§ 371 (c)(1),
(2) Date: Oct. 14, 2016

(87) PCT Pub. No.: WO2015/159094
PCT Pub. Date: Oct. 22, 2015

(65) Prior Publication Data

US 2017/0030156 A1 Feb. 2, 2017

(30) Foreign Application Priority Data

Apr. 17, 2014 (GB) ..... 1406959.5
Oct. 30, 2014 (GB) ..... 1419368.4

(51) Int. Cl.
*E21B 23/08* (2006.01)
*E21B 29/00* (2006.01)
(Continued)

(52) U.S. Cl.
CPC ..... *E21B 37/00* (2013.01); *E21B 23/08* (2013.01); *E21B 29/00* (2013.01); *E21B 33/138* (2013.01);
(Continued)

(58) Field of Classification Search
CPC ..... E21B 17/1078; E21B 23/08; E21B 29/00; E21B 33/138; E21B 37/00; E21B 41/0078; E21B 43/08; E21B 43/114
See application file for complete search history.

(56) References Cited

U.S. PATENT DOCUMENTS 2,586,015 A 2/1952 Edwards
3,254,720 A 6/1966 Huitt et al.
(Continued)

FOREIGN PATENT DOCUMENTS

WO 02032634 A3 8/2002
WO 2015126258 A1 8/2015

OTHER PUBLICATIONS

International Search Report—Written Opinion m PCT/GB2015/051160, 17 pages, dated Dec. 2, 2015.
(Continued)

*Primary Examiner* — Daniel P Stephenson
(74) *Attorney, Agent, or Firm* — Dinsmore & Shohl LLP

(57) ABSTRACT

A method of severing a drill-string comprises reducing the load bearing cross-sectional area of the neck of a connection. The reduction in the area of the neck may be achieved using a precisely located flow-actuated cutter. The cutter may be pumped into the string to land on a seat above the connection. A bypass valve may be provided below the connection to facilitate fluid circulation.

57 Claims, 19 Drawing Sheets

(51) Int. Cl.

| | |
|---|---|
| ***E21B 33/138*** | (2006.01) |
| ***E21B 37/00*** | (2006.01) |
| ***E21B 41/00*** | (2006.01) |
| ***E21B 43/114*** | (2006.01) |
| *E21B 17/10* | (2006.01) |
| *E21B 43/08* | (2006.01) |

(52) U.S. Cl.
CPC ..... *E21B 41/0078* (2013.01); *E21B 43/114* (2013.01); *E21B 17/1078* (2013.01); *E21B 43/08* (2013.01)

(56) References Cited

U.S. PATENT DOCUMENTS 3,547,191 A * 12/1970 Malott ..... E21B 7/18 166/223
4,278,127 A 7/1981 Rankin et al.
5,445,220 A * 8/1995 Gurevich ..... B24C 1/045 166/223
5,839,511 A * 11/1998 Williams ..... E21B 37/00 166/312
6,325,305 B1 * 12/2001 Kuhlman ..... E21B 37/00 166/222
9,416,636 B2 * 8/2016 Myhre ..... E21B 29/06
9,677,364 B2 * 6/2017 Tallini ..... E21B 29/02
10,119,349 B2 * 11/2018 Umphries ..... E21B 29/00
2003/0051870 A1 * 3/2003 Robertson ..... E21B 29/02 166/55
2004/0089450 A1 * 5/2004 Slade ..... B24C 1/045 166/298
2010/0218952 A1 9/2010 Robertson
2011/0061864 A1 3/2011 Umphries et al.
2011/0220357 A1 * 9/2011 Segura ..... E21B 29/002 166/298
2011/0284224 A1 11/2011 Misselbrook et al.
2012/0018158 A1 1/2012 Misselbrook et al.
2013/0192830 A1 8/2013 Watson et al.
2014/0034315 A1 * 2/2014 Tallini ..... E21B 29/02 166/297
2017/0030156 A1 * 2/2017 Churchill ..... E21B 29/00
2017/0037707 A1 * 2/2017 Churchill ..... E21B 29/00

OTHER PUBLICATIONS

Search Report dated Oct. 29, 2014, 5 pages Application No. GB1406959.5.
Search Report dated Nov. 27, 2015 , 3 pages Application No. GB1406959.5.

* cited by examiner

METHOD AND APPARATUS FOR SEVERING A DRILL STRING

CROSS-REFERENCE TO RELATED APPLICATIONS

This application is the U.S. National Phase of PCT/GB2015/051160 filed Apr. 17, 2015, which claims priority of Great Britain Patent Application No. 1406959.5 filed Apr. 17, 2014, and Great Britain Patent Application No. 1419368.4 filed Oct. 30, 2014.

BACKGROUND OF THE DISCLOSURE

This disclosure relates to a method and apparatus for severing a drill string. Examples of the disclosure relate to severing a drill string that has become stuck fast in a bore-hole.

FIELD OF THE DISCLOSURE

In the oil and gas industry access is gained to subsurface hydrocarbon-bearing rock formations by drilling bores from surface. An appropriate drilling rig is positioned on surface and provides mounting and drive for a drill bit mounted on the end of an elongate support member, typically a drill string formed of multiple sections of hollow metal drill pipe. Each section of drill pipe features a lower end provided with a pin connection or male threaded portion, and an upper end provided with a box connection or female threaded portion. The connections feature one or two shoulders which are brought into abutting contact and the connections then further torqued up to pre-stress the threads and secure the connection. The connections must be robust as they will experience significant torque, tension and possibly compression in use. Other elements of the drill string are provided with similar connections.

Typically, a drill string is made up or assembled by joining a "stand" of drill pipe, comprising three pre-coupled sections of drill pipe, to the upper end of the drill string which is supported in and extends upwards from the deck of the drill rig. The connections between the drill pipe sections are made-up to a predetermined torque.

Many modern drilling operations are conducted in challenging environments and involve targeting of formations a significant distance from the drilling rig. For example, much oil and gas exploration and extraction now takes place in deep water and further requires drilling of bores through thousands of metres of subsea rock. Thus, drilling operations, and the apparatus utilised in such operations, are increasingly complex and sophisticated.

Running a deep water drilling rig may involve costs in the region of $1 million per day. The drilling apparatus used may also be expensive, for example the collection of tools and devices which make up a modern bottom-hole-assembly (BHA), as provided at the distal end of the drill string, may have a value of $1 million.

Despite this level of sophistication, and extensive training for relevant personnel, it is still not uncommon for the drill string to become stuck in the hole. In the majority of cases, the location where sticking occurs is at the lower end of the BHA at the drill bit or the stabilisers, larger diameter portions which assist in maintaining or controlling drilling direction. This is primarily because these string elements are the same or just slightly smaller diameter than the drilled bore itself, but also because this is the first apparatus to encounter the newly cut hole, which may be unstable. Of course drillers go to great lengths to avoid becoming stuck.

In the knowledge that sticking is a real possibility, most drill strings are provided with one or more jars, that is devices which facilitate application of shock tension loads to a drill string. In particular, if a certain tension is applied to a jar in a string, energy is stored in the string until the jar suddenly releases the tension, and hopefully frees the stuck drill string. When a drill string gets stuck, drillers are trained to use the jars immediately to try and free the string; it is well known that the probability of getting free diminishes quickly with time. The first few seconds and minutes are critical and with each passing hour of being stuck, success becomes less and less likely; after a day of being stuck the probability of recovering the BHA and getting free is remote.

Once the rig management has decided that a stuck drill string cannot be freed, efforts will be made to part the drill pipe as low down as possible in the string, in order to retain as much of the hole as possible, and to retrieve as much of the drill string as possible. A further string may then be run into the hole and attached to the top of the remaining stuck section of drill pipe, known as the "fish". This further string may be equipped with more powerful fishing jars than may be provided in a drill string, or with other specialised retrieval apparatus. Attempts may then be made to retrieve the stuck section of drill string. However, the fishing option is often not even attempted for economic reasons; by the time the pipe has been parted and pulled to surface the fish has likely been stuck for several days and the probability of freeing it is slim.

Thus, as soon as the pipe has been parted, or following an unsuccessful fishing operation, the lower end of the bore will be filled with cement to create a kick-off plug, and the bore subsequently side-tracked around the plug and the stuck section of string.

There are several known methods of parting the pipe, as will be described below. In a "blind back-off", the aim is to unscrew or back out a threaded connection in a lower part of the string. This involves the driller first calculating the tension or "hook-weight" that should be applied to the string at surface in order to put the target connection in zero tension (this is called the neutral point). The driller then winds reverse torque into the string and hopes that the target connection unscrews. While this method is unreliable it requires no additional equipment.

Greater reliability tends to be achieved using e-line pipe parting methods, although this typically requires two electric wireline crews (typically six people) to be transferred to the rig, together with their equipment. Of course this involves significant expense, but the lost rig time is likely to be much more expensive. The crews will run a free-point indicator into the well to assess exactly where the pipe is stuck; the pipe should be cut directly above the stuck point. The crews will then run in with explosive charges to part the pipe. The first option is often a back-off charge. This is similar to a blind back off, as described above, except that there is a detonation of a charge at the target connection, the resulting shock wave facilitating unscrewing of the target connection. Such an operation is preferred as the box connection is left intact and in good condition for a retrieval attempt. Failing that, the crews will simply seek to detonate charges and blow the pipe apart at a connection. This is not always achievable, and when successful the remains of the severed connection can be difficult to engage with a grapple or fishing tool.

Jet cutters, including a shaped explosive charge, provide a more targeted shock wave to cut through smaller diameter pipe. Chemical cutters direct a chemical, usually bromine trifluoride, through a catalyst and then through nozzles and onto the pipe walls. Mechanical cutting requires a cutting tool to be run into the stuck pipe on a work string, which is time-consuming.

US Patent Application Publication No. US 2011/0061864 describes a "wireless pipe recovery system" in which a series of specialised subs are provided in the BHA and are configured to receive an explosive firing head that has been dropped from surface. Each of the subs has a different sized flange so that the explosive charges can be dropped into a selected part of the BHA. The subs are formed of double wall tubes with the inner tube configured to hold tension and pressure and the outer tube transmitting torque and providing rigidity. The inner tube includes a reduced wall thickness portion which is more readily cut by the explosive charge.

Implementing this system requires the inclusion of the specialist subs in the drill string, at additional expense to the operator. Further, if a drill string provided with the subs becomes stuck, a specialist explosives-handling crew, and the specialist explosive equipment, must be transferred to the rig before the pipe parting operation can begin.

SUMMARY OF THE DISCLOSURE

According to one aspect of the present disclosure there is provided a method of severing a drill-string formed from drill string sections including pin connections having a neck between a threaded portion and a shoulder, the method comprising reducing the loadbearing cross-sectional area of the neck of a connection.

Another aspect of the disclosure relates to apparatus configured for reducing the loadbearing cross-sectional area of a neck of a pin connection of a drill string section.

A conventional pin connection includes a frusto-conical threaded portion spaced from a shoulder by a neck portion that may be formed to provide for some stress relief. The neck portion provides a transition between the shoulder and the threaded portion and may be shaped to provide clearance from the adjacent box connection and to avoid sharp angles or corners that would provide for stress concentration. The neck portion may have a reduced wall thickness relative to the base of the threaded portion and may form the thinnest part of the dill string section wall at the connection. The drill string section may be drill pipe, a drill collar, or some other element of a drill string.

Of course drill string elements, and the connections between the elements, are intended to be robust and to withstand extreme forces. Accordingly, severing a dill string element is often a difficult operation and success cannot be guaranteed. However, by targeting what is generally the thinnest uncoupled part of the connection, that is the neck between the threaded pin and the shoulder, a successful separation of the string is more likely, without the requirement to provide unconventional subs in the string.

Generally the thickness of the neck of the pin is approximately 40% of the total thickness of the connection, and the neck is the innermost part of the connection, often defining the smallest internal diameter of the drill string section, and thus relatively easily accessed by an internal cutter. If the connection has been correctly made-up, the torque on the connection will be such that the stress in the neck of the pin is around 60-70% of the material yield strength. As material is removed the pin extension distance remains the same, so stress will reduce. Accordingly, it may be desirable to wind back torque into the connection to increase the stress; conventionally an operator will only wind in a maximum of 80% of the lowest make-up torque in the string.

Cutting the string at the neck of the pin also offers the advantage that this leaves the outside diameter (OD) of the box connection relatively unscathed and ready to be latched onto by a grapple or other fishing tool. The box connection is also relatively robust, and will be further reinforced by the presence of the threaded portion of the pin which remains in the box. The upper outer edge of the box is also chamfered, facilitating location of the grapple on the box.

As noted above, an operator may apply or wind in torque to the drill string. Thus, as the load-bearing cross-sectional area of the pin is reduced, the neck of the pin may yield and fail. Alternatively, or in addition, the operator may apply tension to the drill string. The combination of applied torque and tension may result in string shearing relatively quickly.

In other embodiments the loadbearing cross-sectional area of the neck may be reduced to zero, such that it is not necessary to apply additional torque or tension.

The loadbearing cross-sectional area may be reduced by eroding or removing metal from the inside of the connection.

The loadbearing cross-sectional area may be reduced by operating a cutter, which cutter may utilise any suitable material removal method, for example by mechanical cutting or material removal or displacement, by fluid erosion, or by chemical erosion.

The reduction of the loadbearing cross-sectional area of the neck may be achieved by forming a circumferential cut. The cut may be circumferentially continuous, for example as would be formed by a circumferentially continuous jet of high speed cutting fluid, or by a cutting tool which rotates around the axis of the drill string. Alternatively, the cut may be circumferentially discontinuous, for example as would be formed by a series of radially directed and circumferentially spaced jets of cutting fluid.

Fluid erosion may be achieved by directing fluid towards the neck surface through a fluid cutter. The fluid may be formed into a high speed jet, for example by pumping fluid through a flow constriction, restriction or nozzle. The fluid may travel at a suitable speed to achieve a desired rate of material removal, for example the fluid speed may be 100 feet/sec or more. The cutting fluid may be provided in the form of a circumferentially-continuous stream, with the aim of providing a continuous circumferential cut, or may be discontinuous, for example in the form of a series of discrete jets or streams. The flow constriction, restriction or nozzle may rotate around the axis of the string, or may be stationary. The cutting fluid may be pumped down the drill string bore, or may be pumped through an intermediate conduit, for example coil tubing or a small diameter tool string run inside the drill string. The cutter may be associated with a seal such that the all of the fluid pumped down the string is directed into the cutter. An abrasive material, such as sand, may be added to the cutting fluid to increase the cutting effect.

A rotatable mechanical cutter may be utilised, which cutter may include a radially extendable cutting member. Alternatively, or in addition, an impact cutter may be utilised, in which a reciprocating cutting member is driven radially into a surface of the neck. The cutter may be fluid powered, for example via a mud motor or a turbine. The fluid to power the cutter may be pumped down the drill string, or may be pumped through an intermediate conduit, for example coil tubing run inside the drill string. Alternatively, or in addition, the cutter may be electrical powered, via an electric motor. The power for the motor may be supplied from a local source, such as a battery, or may be delivered from surface, for example via electric wireline. In other embodiments a mechanical input may be provided for the cutter, for example by utilising a small diameter tool string or coiled tubing.

The cutter may be controlled or monitored by signals transmitted from and to surface. The signals may be transmitted through the fluid in the drill string, for example as pressure pulses, or may be transmitted along a signal carrier, such as a wire or optical fibre.

The cutter may be run into the drill string on a support member, for example a reelable support such as wireline or coiled tubing. Alternatively, the cutter may be pumped or dropped into the drill string.

The cutter may be provided in combination with a cutter locator, to ensure the accurate location of the cutter relative to the neck to be cut. The locator may include a profile dimensioned to engage a seat provided in the drill string. A plurality of seats, for example but not exclusively of progressively smaller diameters, may be provided for cooperation with a respective cutter. This allows an operator to select predetermined cutter locations in the string, for example directly behind the leading stabiliser, and above and below the jars. The locator and seat may form a seal therebetween. Alternatively, a seal may be provided separately of the locator. The seat may be configured for location in a conventional drill string element. Alternatively, the seat may be configured for location in a specially adapted drill string element, and may be integral with the element.

A fluid bypass device may be provided in the string and may be activated to facilitate fluid circulation through the string. A bypass device may be operated to permit fluid to flow directly from the drill string bore, through a port in the wall of the string, into the annulus between the drill string and the surrounding bore wall, thus bypassing the drill bit jetting nozzles and other devices towards the distal end of the drill string. This may be useful where the string has become packed off, and normal fluid circulation is no longer possible, or to provide for a higher flow rate, for example to provide a greater flow of fluid through a hydraulic cutter or to a cutter motor, and thus provide for faster cutting. The bypass device may be a bypass device provided for use in other bypass operations, and may be capable of multiple activations. Alternatively, the bypass device may be a device intended for activation only when the drill string is stuck and is intended to be severed. As such the bypass device may be a single-use device of relatively simple construction and operation. The bypass device may be ball or dart-activated, and the dart may be configured to be retrievable, for example by provision of a fishing profile. The bypass device may be provided below the intended severing location. A plurality of bypass devices may be provided in the drill string, each of which may be associated with a particular severing location.

The connection to be severed may be a conventional connection, or a connection may be provided which facilitates severing. For example, the neck of the connection may be formed of a material which facilitates material removal by a cutter. The connection intended to be severed may be a single or double shouldered connection.

The connection to be severed may be provided in a sub adapted to receive and locate a cutter.

In other aspects of the disclosure the severing may take place at another location in the string. Again, the severing may take place in a conventional drill string element, or a drill string element intended for severing may be provided.

The various features described above may also be provided in combination with the other aspects of the disclosure as described herein. Furthermore, it will be apparent to the skilled person that the other aspects of the disclosure as described herein, and the optional and alternative features described with reference to these aspects, may also be utilised in combination with the first-described aspects and indeed with any aspect of the disclosure.

According to a further aspect of the present disclosure there is provided a method of severing a drill string, the method including: dropping or pumping a flow-actuated cutter into a drill string; landing the cutter at a predetermined location in the string; and pumping fluid down through the drill string and through the cutter to actuate the cutter and remove material from a selected portion of the drill string.

An alternative aspect of the disclosure provides apparatus for severing a drill string, the apparatus comprising a flow-actuated cutter configured to be dropped or pumped into a drill string and to land at a predetermined location in the string, whereby circulating fluid down through the drill string actuates the cutter to remove material from a selected portion of the drill string.

The cutter may thus be translated quickly from surface to the desired location in the drill string, and without the requirement to, for example, provide and set up a wireline rig or make up a tool string. The operator is also free to, for example, manipulate the drill string as the cutter translates down through the string, and also free to apply torque or tension to the string, which would be more difficult if the cutter was run into the bore on a support member. Further, once the drill string has been severed, the drill string may be retrieved immediately, or may be used to deliver cement to form a kick-off plug. The cutter may be retrieved together with the string, or may be configured to disengage from the string following severing of the string. The use of a flow-actuated cutter also obviates the requirement for the presence of specially trained operators, for example as would be the case if explosives or cutting torches were to be used. The cutter may also be stored and handled on the rig, thus being immediately accessible when required. Further, the existing rig mud pumps, and conventional or only lightly modified drilling mud, may be utilised to actuate the cutter conventional mud pumps are very powerful and operation of the pumps and handling of drilling fluid will be familiar to the operators.

The cutter may be configured such that the fluid exits the cutter in a high velocity stream directed towards an inner surface of the string. The cutter may define a flow passage and the flow passage may define a constriction, restriction or nozzle to provide the high velocity outlet stream at a flow passage outlet. Portions of the flow passage may be formed of an erosion resistant material, for example a hard facing material such as tungsten carbide or a ceramic. A fluid outlet may be configured to be directly adjacent an inner surface of the drill string. The cutter may be configured such that fluid exits the cutter at a transverse angle to the string axis, or the fluid flow may be inclined relative to the string axis. At least the inlet to the flow passage may be parallel to the string axis. The cutter may be configured such that the fluid exits the cutter in a stream intended to create eddies or vortices to enhance the erosive effect of the fluid.

A seal or flow restriction may be provided between the cutter and the string to control the flow direction of the fluid once the fluid has exited the flow passage and impinged on the string wall. In one embodiment the cutter body carries an external seal configured to engage with a seal bore provided in the string above the selected portion of the string. Typically, fluid will be pumped from surface down through the string, be directed through the cutter to impinge on the string wall and then be directed down the string. The fluid may then pass down to the end of the string before exiting the string and circulating back to surface via the annulus between the string and the surrounding bore wall. More likely however, the fluid will exit the string through an open bypass port or valve provided in the string below the cutter.

The fluid may exit the cutter in a continuous circumferential stream, with the aim of providing a circumferential cut, or may be discontinuous, for example a series of discrete jets. The fluid outlet may rotate around the axis of the string, or may be stationary. The cutter may be associated with a seal between the flow passage inlet and outlet such that the all of the fluid pumped down the string is directed into the cutter. The seal may be provided between the cutter body and the string and may also, as described above, assist in controlling the flow of the fluid after the fluid has exited the cutter. An abrasive material, such as sand, may be added to the cutting fluid to increase the cutting effect.

A filter may be provided in the fluid circulation path to avoid larger particles reaching the cutter and potentially blocking the flow path through the cutter. The filter may be provided in the drill string at surface, or at any suitable location in the drilling fluid circulation path, for example upstream of a standpipe manifold. The filter may be configured to be readily retrofitted into the deck-mounted drilling mud circulation equipment in the event of a decision to deploy the cutter.

The cutter may include a mechanical cutting member, which member may be rotated or radially extended. The member may be driven by a mud motor or turbine. The cutter may be powered by a mud motor, which may be a positive displacement motor, or a turbine.

The cutter may be provided in combination with a cutter locator, to ensure the accurate location of the cutter relative to the portion of the drill string to be cut. The locator may include a profile dimensioned to engage a seat provided in the drill string. A seat may be located above or below the selected portion of the string. In one embodiment the seat may be provided by a catcher ring, which ring may feature external seals and may be adapted for location in an upper part or a lower part of a locating sub. A plurality of seats, for example but not exclusively of progressively smaller diameters, may be provided for cooperation with a respective locater. This allows an operator to select the location of the cutter in the string. The locator and seat may engage to form a seal therebetween, or a seal may be provided separately of the locator and seat. The seat may be configured for location in a conventional drill string element. Alternatively, the seat may be configured for location in a specially adapted drill string element, and may be integral with the element.

Where the cutting locator is configured to engage a seat provided below the selected portion of the drill string, a seat bypass may be provided to facilitate flow of fluid away from the cutting location and past the seat. The seat bypass may extend through one or both of the cutter body and a drill string element.

The cutter may include one or more stabilising portions for restricting lateral movement of the cutter in the drill string. Stabilising portions may be provided above or below the cutting location, and may be provided both above and below the cutting location. A cutting operation may generate significant forces in and on the cutter, and stabilising the cutter may facilitate a reduction or remediation of forces or vibration experienced by portions the cutter, thus extending cutter life or requiring less robust construction of the cutter. A stabiliser portion may comprise a portion of cutter dimensioned to be a close fit inside a cooperating portion of the string.

A fluid bypass device may be provided in the string and may be activated to facilitate fluid circulation through the string. This may be useful where the string has become packed off, and the normal fluid circulation route is no longer available, or to provide for a higher flow rate, for example to provide a greater flow rate through the cutter. The bypass device may be a bypass device provided for use in other bypass operations, and may be capable of multiple activations. Alternatively, the bypass device may be a device intended for activation only when the drill string is stuck and is to be severed. As such the bypass device may be a single-use device of relatively simple construction and operation. The bypass device may be ball or dart-activated. The bypass device may be provided below the intended severing location. A plurality of bypass devices may be provided in the drill string, each of which may be associated with a particular severing location.

A fluid bypass device may be provided above the intended severing location. Such a device may be opened after the drill string has been severed to, for example, facilitate pumping of cement through the string to form a kick-off plug. Alternatively, or in addition, the cutter may be configured or be reconfigurable to allow the cutter to drop out of the severed string or open a less restricted flow path through the string.

The selected portion of the drill string to be severed may be at a connection, and may be a neck of a pin, as described in relation to the first aspects.

According to a still further aspect of the present disclosure there is provided a method of severing a drill string, the method comprising: opening a bypass valve in a stuck string; locating a flow-actuated cutter in the drill string; and circulating fluid through the drill string to actuate the cutter and remove material from a selected portion of the drill string.

Another aspect of the disclosure relates to apparatus for severing a drill string, the apparatus comprising: a bypass valve configured for location in a drill string; and a flow-actuated cutter configured to be run into the drill string and positioned above the bypass valve, whereby, in use, the bypass valve is opened and fluid circulated through the drill string to actuate the cutter and remove material from a selected portion of the drill string.

In a situation where a drill string becomes stuck in a wellbore, the annulus between the drill string and the surrounding bore wall is often packed-off, preventing or restricting the ability to circulate fluid through the string. However, opening a bypass valve in the string facilitates operation of the flow-actuated cutter. Even where the string is not packed off, the ability to bypass the jetting nozzles in the drill bit, and other fluid constrictions or restrictions below the bypass valve, allows fluid to be circulated at a higher flow rate, potentially increasing the cutting rate.

The ability to flow through a bypass valve is also a useful indicator of whether a packed-off drill string is stuck above the bypass valve location. In particular, if an operator follows the procedures required to open the lowest bypass valve in the string and this does not result in restoration of circulation, this indicates that the string is packed-off, and also stuck, above the bypass valve. This process may be repeated for each bypass valve. If opening of a bypass valve restores circulation, this indicates that the string is not packed-off above the valve and the free point is located below the valve. Thus, the operator may then locate and actuate a cutter directly above the valve.

This aspect of the disclosure may be provided in combination with the various features described above with reference to the other aspects. Furthermore, the various features described below may also be provided in combination with the earlier-described aspects.

Once the pipe string has been severed, the upper portion of the string may be used to deliver cement into the bore and form a kick-off plug above the lower portion of the string that remains in the bore, allowing the operator to then drill around the lower portion of the string.

Alternatively, attempts may be made to remove the lower portion of the string from the bore. The upper portion of the string may be removed from the bore and a further string run into the bore to engage or mate with the top of the lower section of the string that remains in the hole. The further string may be provided with a fishing assembly configured to securely latch on to the lower section of the string. The further string may include a jar or the like to facilitate an attempt to jar or otherwise free the remainder of the string from the hole. Apparatus or devices, such as an activating device for the bypass valve, or devices containing radioactive or nuclear sources, may be removed from the lower section of the string, for example by passing wireline equipped with a fishing tool through the further tool and into the lower section of the tool.

The disclosure also relates to a drill string incorporating the apparatus as described above.

Although the above aspects are described with reference to severing stuck drill pipe, it will be apparent to those of skill in the art that the various methods and apparatus may be adapted for other purposes, for example cutting profiles in pipe or other tubulars. Thus, cutting methods or apparatus incorporating selected individual or multiple features as described above may be adapted for cutting casing to, for example, facilitate a casing-retrieval operation. However, for a casing cutting operation a cutter may be mounted on a support string.

It should be understood that the individual features defined above in accordance with any aspect of the present disclosure or below in relation to any specific embodiment of the disclosure, or in any of the appended claims, may be utilised, either alone or in combination with any other defined feature, in any other aspect or embodiment of the disclosure.

BRIEF DESCRIPTION OF THE DRAWINGS

These and other aspects of the drawings will now be described, by way of example, with reference to the accompanying drawings, in which.

DETAILED DESCRIPTION OF THE DRAWINGS

Figure 1:
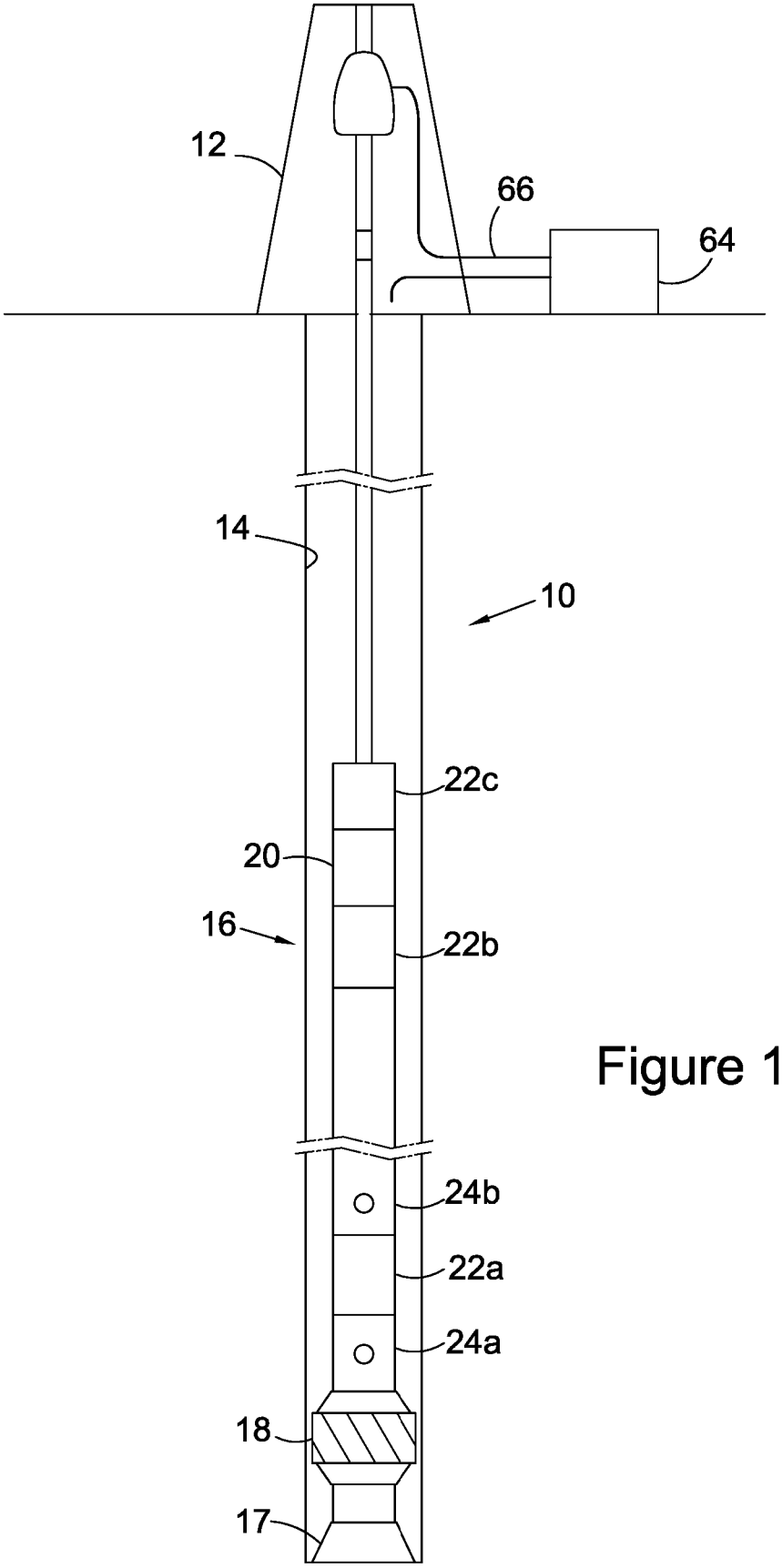
FIG. 1 is a schematic illustration of a drill string incorporating drill string severing apparatus in accordance with an embodiment of the present disclosure.

Reference is first made to FIG. 1 of the drawings, which is a schematic illustration of a drill string 10 incorporating drill string severing apparatus in accordance with an embodiment of the present disclosure. The string 10 is supported from a surface rig 12 and extends through a drilled bore 14. A bottom-hole-assembly (BHA) 16 is provided on the lower end of the string 10 and includes, among other things, a drill bit 17, a near-bit stabiliser 18 and a jar 20. The BHA 16 further incorporates three cutter-locating subs 22*a*, 22*b*, 22*c* in accordance with an embodiment of the present disclosure, one sub 22*a* being positioned above the near-bit stabiliser 18, and one each of the other subs 22*b*, 22*c* being positioned below and above the jar 20. Bypass valves 24*a*, 24*b* are also provided in the BHA 16 above and below the lowermost sub 22*a*, and similar valves may also be provided in conjunction with the other subs 22*b*, 22*c*.

In the event of the string 10 becoming stuck in the bore 14, the driller will initially use various methods to attempt to free the string, including using the jar 20. However, if this is unsuccessful, the decision may then be taken to sever the drill string 10 above the stuck point. Depending on the location of the stuck point, the driller will then take steps to pump or drop a cutter into the most appropriate sub 22*a-c*, as will be described below.

Figure 2:
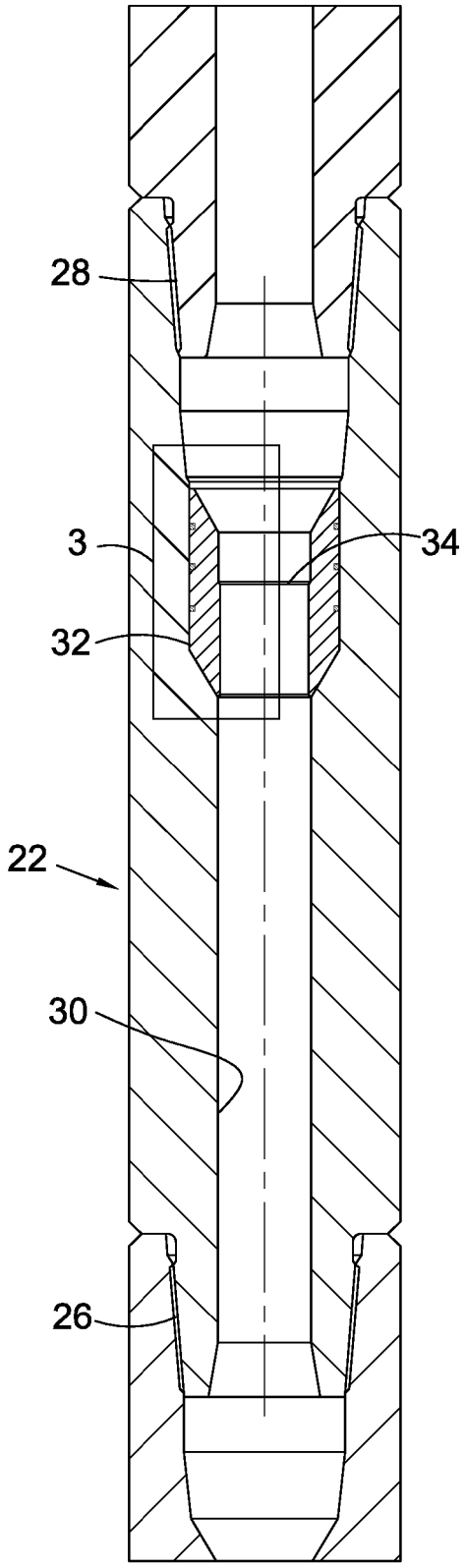
FIG. 2 is a sectional view of a drill string sub forming part of the apparatus of FIG. 1.
Figure 3:
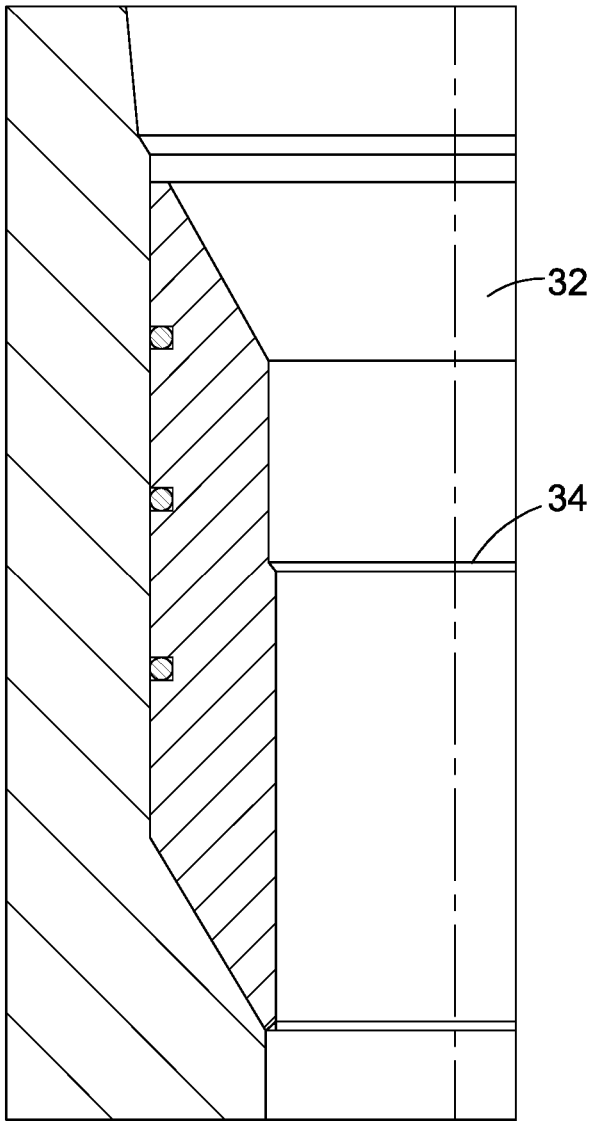
FIG. 3 is an enlarged view of area 3 of FIG. 2.

Reference is now also made to FIG. 2 of the drawings, an exemplary sectional view of one of the cutter-locating subs 22; the subs 22*a-c* only differ in the dimension of a dart-catching seat, as will be described. The illustrated sub 22 has an 8¼" outside diameter (O.D.) with standard 6⅝" regular pin and box connections 26, 28, is 36" long and has a standard 2¹³⁄₁₆" internal through bore 30. With these dimensions and standard material the connections 26, 28 would typically have been torqued up to 54 k ft-lbs when the sub was incorporated in the string, and should be capable of handling 750 tonnes of pull (1.5 million pounds).

The upper end of the sub 22 houses an externally-sealed catcher ring 32 with a precisely located catcher seat 34. It will be noted that the seat 34 has a very small radial extent, and in the illustrated embodiment has been designed to catch a pin cutter dart 36 (FIG. 4) with an external profile 38 with an outer diameter of just less than 2.75". Thus, the seat 34 permits passage of smaller diameter tools or devices, such as the darts utilised to activate the applicants circulating/bypass valve as marketed under the DAV trade mark; the largest of these darts has an outer diameter (O.D.) of 2.69", such that one or more bypass valves may be provided in the string 10, below the sub 22. The ability to operate a bypass valve below the sub 22 is useful if the string is fully or partially packed off below the sub 22, as it is desirable to re-establish fluid circulation, for well safety and control reasons, as well as facilitating operation of the pin cutter dart 36. Thus, a bypass valve-activating device, for example in the form of a dart or ball, may be dropped or pumped through the string 10, pass through the sub 22, and engage and open a bypass valve 24 below the sub 22.

Figure 4:
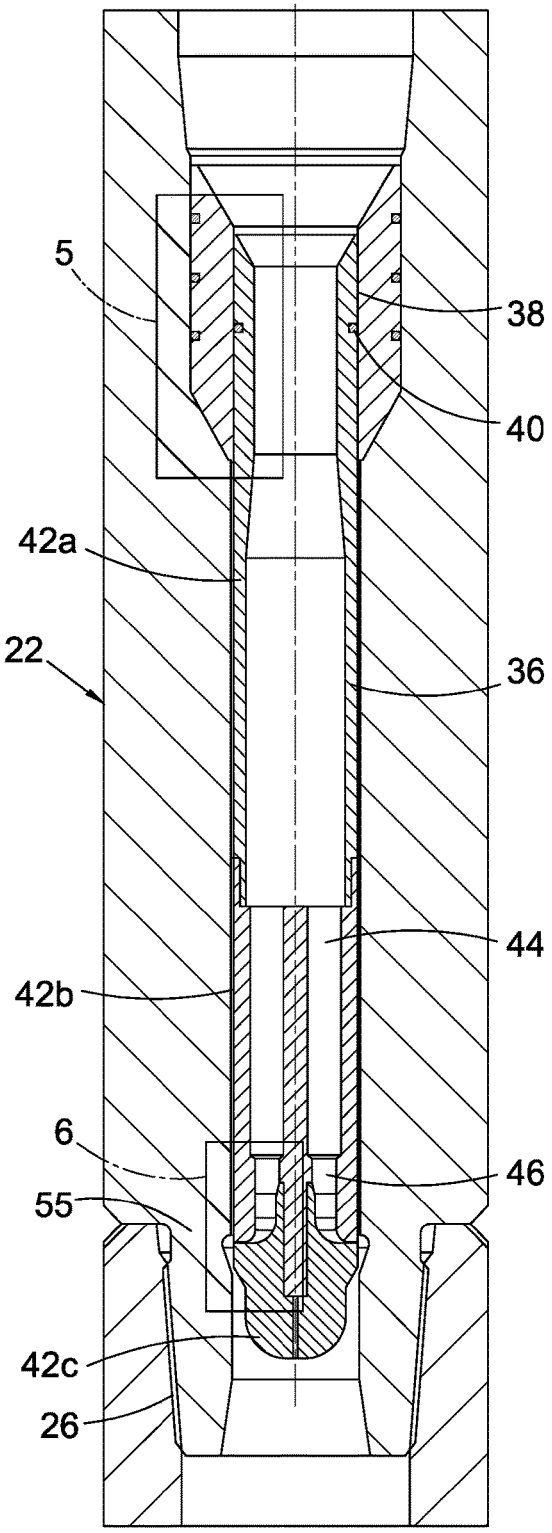
FIG. 4 shows the sub of FIG. 2 with a pin cutter dart in accordance with an embodiment of the present disclosure landed in the sub.
Figure 5:
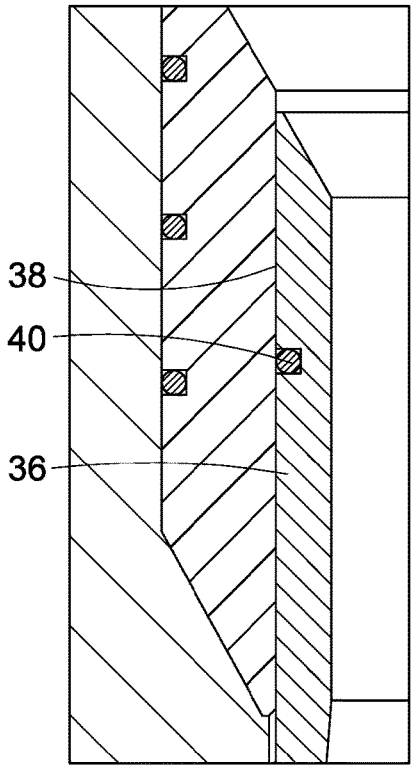
FIGS. 5 and 6 are enlarged views of areas 5 and 6 of FIG. 4.
Figure 6:
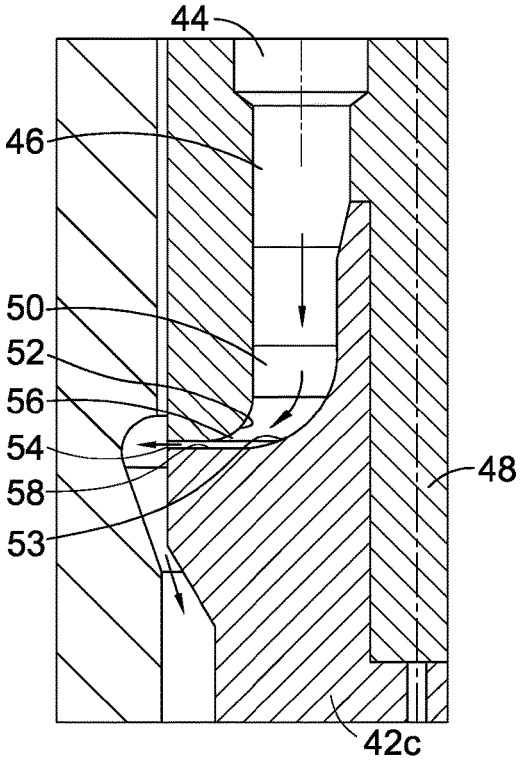

Reference is now also made to FIGS. 4, 5 and 6 of the drawings, which show the sub 22 with a pin cutter dart 36 landed in the sub 22. As noted above, the upper end of the dart 36 features a locating profile 38 dimensioned to engage with the seat 34. Also, an external seal 40 on the dart 36 ensures that any fluid being pumped down through the string 10 is directed through the dart 36. The dart 36 is pumped into place relatively gently; on landing there would be a significant pressure increase as drilling fluid/mud was then forced to pass through the dart 36.

The dart 36 comprises three main sections 42*a*, 42*b*, and 42*c*. As described above, the hollow top section 42*a* is profiled to land, locate and seal in the sub 22. The top section 42*a* is screwed into a mid-section 42*b* which has an interior configured to provide annular flow into the bottom part 42*c*. An upper part of the mid-section 42*b* defines four radially spaced axial flow passages 44 which direct fluid into an inner annulus 46 in the lower part of the mid-section 42*b*. An inner core 48 of the annulus 46 is threaded to attach it to the bottom part 42*c*, which is in the form of a nose. The annulus 46 directs fluid into a narrowing annular passage 50 formed between an inner surface 52 of the mid-section 42*b* and an opposing surface 53 of the nose 42*c*. The passage 50 funnels the flow of mud into a radially travelling, circumferential jet of mud which exits the passage nozzle or outlet 54 precisely at the mid-point of the stress relieving groove or neck 55 of the pin 26.

Before assembling the dart 36, the jet-defining surfaces 52, 53 are both spray-coated with tungsten carbide 56, 58 to prevent them from eroding. Tungsten carbide 60, 62 (labelled on FIG. 7) is also applied onto the outer diameters (O.D.s) of the sections 42*b*, 42*c* at the passage outlet 54 and then ground down to an exact, polished O.D. Similarly, the flat surfaces of the passage 50 leading to the outlet 54 are polished to an exact thickness so that the jet gap can be engineered exactly and to ensure minimal flaring, to concentrate the flow onto the internal diameter (I.D.) of the pin 26. In the illustrated embodiment, the outlet 54 is 0.020" (deep. This provides a jet total flow area of 0.14 square inches. To pump mud through such a gap at a rate of 250 gallons per minute (gpm) requires mud pressure of approximately 2500 psi, which is readily achievable using just one typical rig mud pump 64 (FIG. 1). This flow rate generates jet velocities of over 500 feet/sec.

Such a high velocity flow of drilling mud will cause the metal at the inner diameter of the pin 26 to erode away rapidly. Further, the passage outlet 54 is very close to the pin ID and thus there is little opportunity for the energy of the jet to dissipate.

Figure 7:
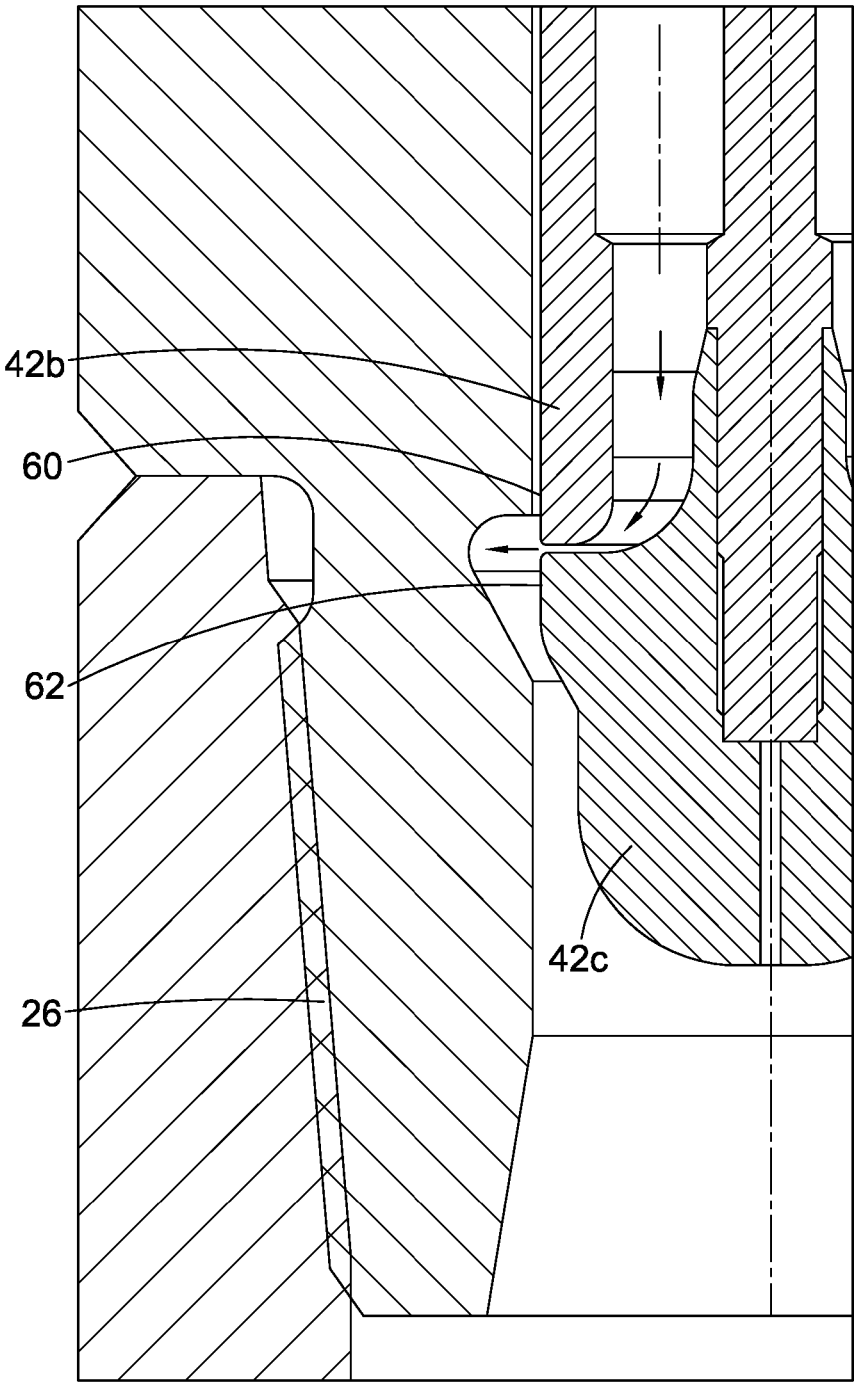
FIGS. 7 and 8 correspond to FIG. 6 and illustrate the progression of erosion of the neck of the pin of the sub.
Figure 8:
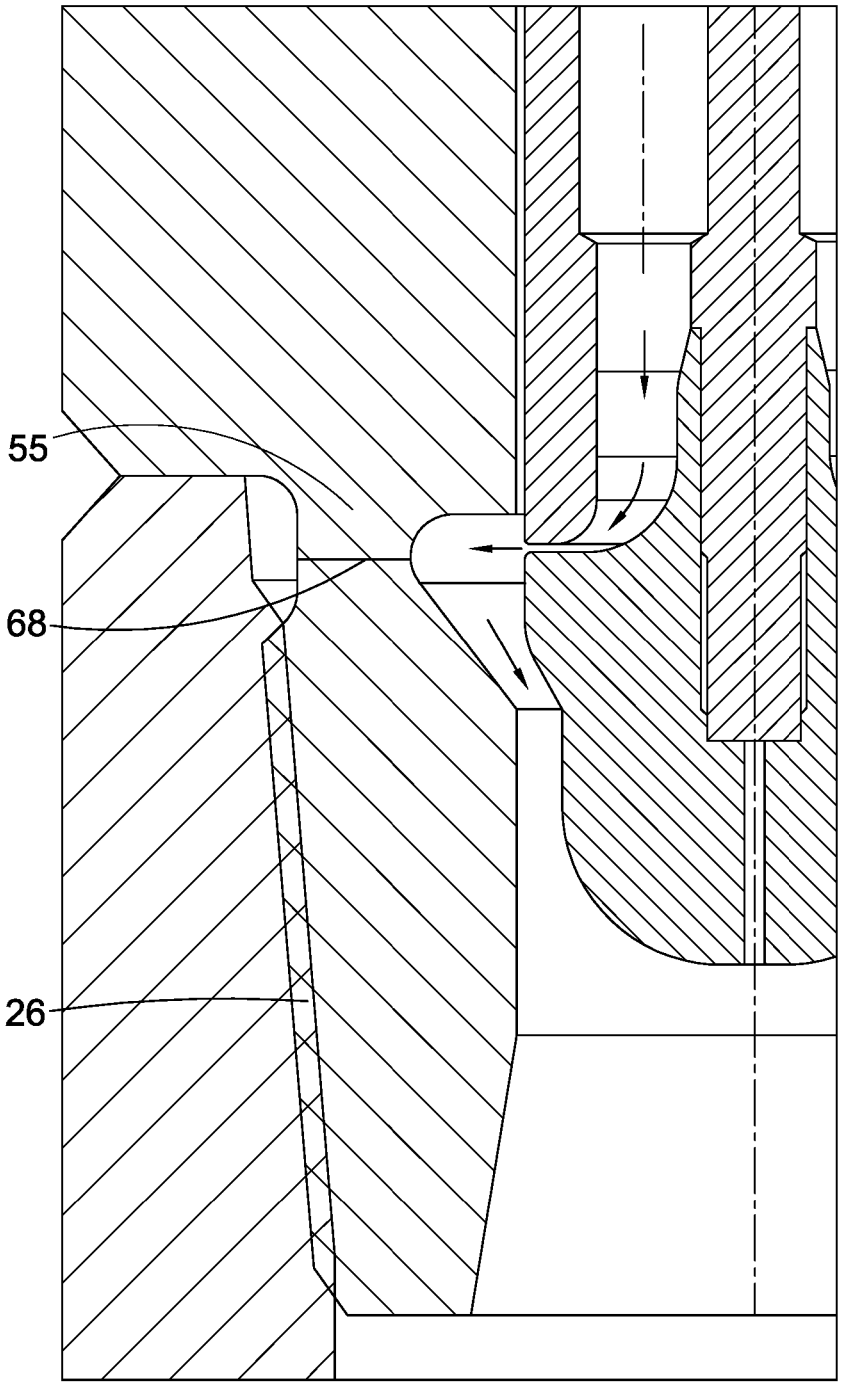

FIGS. 7 and 8 of the drawings illustrate the progression of erosion of the pin 26, FIG. 8 illustrating the point where the stream of fluid has eroded half the distance through the neck of the pin 26. The cross-sectional area of the neck 55 that has been lost at this stage is around 42% and thus the pre-stressed pin 26 may well simply part along the line 68. To ensure even more rapid failure of the weakened pin 26, the driller may utilise the rig 12 to wind torque into the string 10 to further stretch the pin neck 55, and also to apply an over-pull to the string 10 of up to several hundred thousand pounds. This directly adds to the stress in the neck 55, causing the pin 26 to part earlier.

In this example, with a gap at the outlet 54 of 0.020", pumping fluid at a higher flow rate would provide a higher jet velocity and the pump pressure would rise exponentially. If the gap was, for example, 0.040" or 0.060" the same jet velocity would be generated at the same pressure by pumping fluid at 500 gpm and 750 gpm, respectively. However, the hydraulic horsepower at the nozzle 54 would double and treble respectively. This would make the cutting much quicker, both purely because of the increased power (proportional to both flow-rate and pressure drop), and also because a bigger stream of mud jet would retain its energy for a longer distance, making it more effective at eroding the last of the metal which will progressively get further away from the circumferential nozzle outlet 54 as the metal is eroded.

The speed of the erosion also depends to some extent on the solids/sand content of the mud. Sand is naturally picked up when drilling, but in general mud engineers try to keep the sand content to a minimum to prevent erosion and wear in the apparatus in contact with the mud. However, it is difficult to remove the fine sand without also stripping out additives which have been intentionally incorporated in the mud. In this disclosure however, the presence of some fine sand may have a beneficial effect. Indeed, it is possible to temporarily add sand or some other abrasive particles to the circulating fluid, to achieve a shot blast effect.

To minimise the risk of plugging the nozzle 55, a filter 66 may be positioned at a suitable location in the deck-mounted drilling fluid circulation apparatus, for example upstream of a standpipe manifold (FIG. 1), to remove any larger particles and to avoid clumps of particles passing into the string 10. The filter 66 may be configured to be readily retrofitted into the fluid circulation system, in preparation for activation of the cutter 36.

It many cases it is likely to be the case that the cutting effect achieved with unmodified drilling mud is sufficient such that there is no need to add extra torque to the connection or put additional tension into the 10 string to part the pin 26 in a reasonably short period of time.

After the pin 26 has parted it may be desired to improve the flow through the dart 36, for example to allow cement to be pumped through the string 10, and to provide access to the portion of the string below the dart 36. This may be achieved by dropping a second dart onto the dart 36, the second dart being configured to, for example, facilitate washing an opening in the wall of the upper section 42*a*, or the second dart releasing a retractable landing profile on the first dart. Alternatively, the dart 36 could be fished out of the string. This latter option offers the advantage of permitting access through the upper part of the severed string to tools and devices in the lower part of the string which it may be necessary or desirable to remove from the bore. Improved flow could also be achieved by opening a bypass valve in the string above the dart 36.

After the drill pipe has been parted attempts may be made to retrieve the remaining stuck portion of the drill pipe.

As will be noted from FIG. 1, in this embodiment there are three cutter-locating subs 22*a-c* provided at different locations in the BHA 16, each being supplied with matching darts and seats such that a dart destined for a lower sub will pass through an upper sub. This may be achieved by providing different diameter seats matching different dart diameters in decreasing diameters. Thus the driller may land a pin cutter dart in the most appropriate sub; that is the sub directly above the stuck point.

In an alternative embodiment the dart may be configured to provide a series of radially directed and circumferentially spaced nozzles rather than a continuous circumferential jet. This result in the hydraulic drilling of a corresponding number of holes through the pin neck 55 until the pin fails. In other embodiments the nozzles could be arranged asymmetrically to concentrate flow on one side, to induce a tearing effect. Alternatively, radially directed and circumferentially spaced nozzles could be provided on a bearing-mounted nose with the nozzles angled to spin the nose, thus forming a continuous circumferential cut in the pin.

Rather than forming a narrow passage in a dart to wash-cut the pin neck, a dart could position a very hard curved ring very close against the ID of the pin neck so that fluid was forced to flow through a very narrow gap between the ring and the pin. The metal at the pin neck would then be washed away as the fluid was forced past. The resulting eroded gap between the ring and the pin would also facilitate pumping a cement kick off-plug into the bore immediately following parting of the pin. In a still further embodiment the ring could be expanded as the pin was eroded, to maintain a tight gap.

Figure 9:
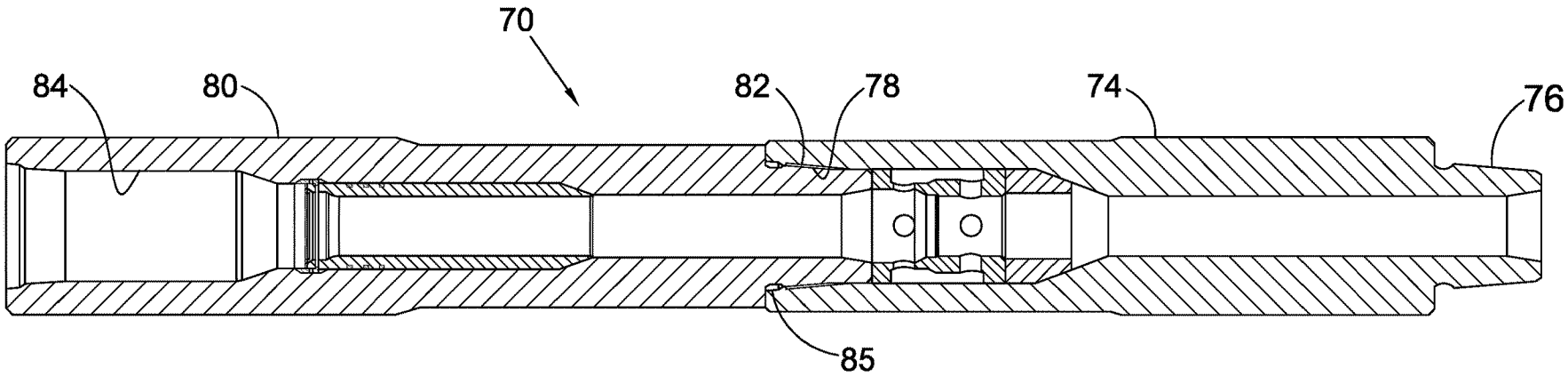
FIG. 9 is a sectional view of a drill string sub assembly of an alternative embodiment.
Figure 10:
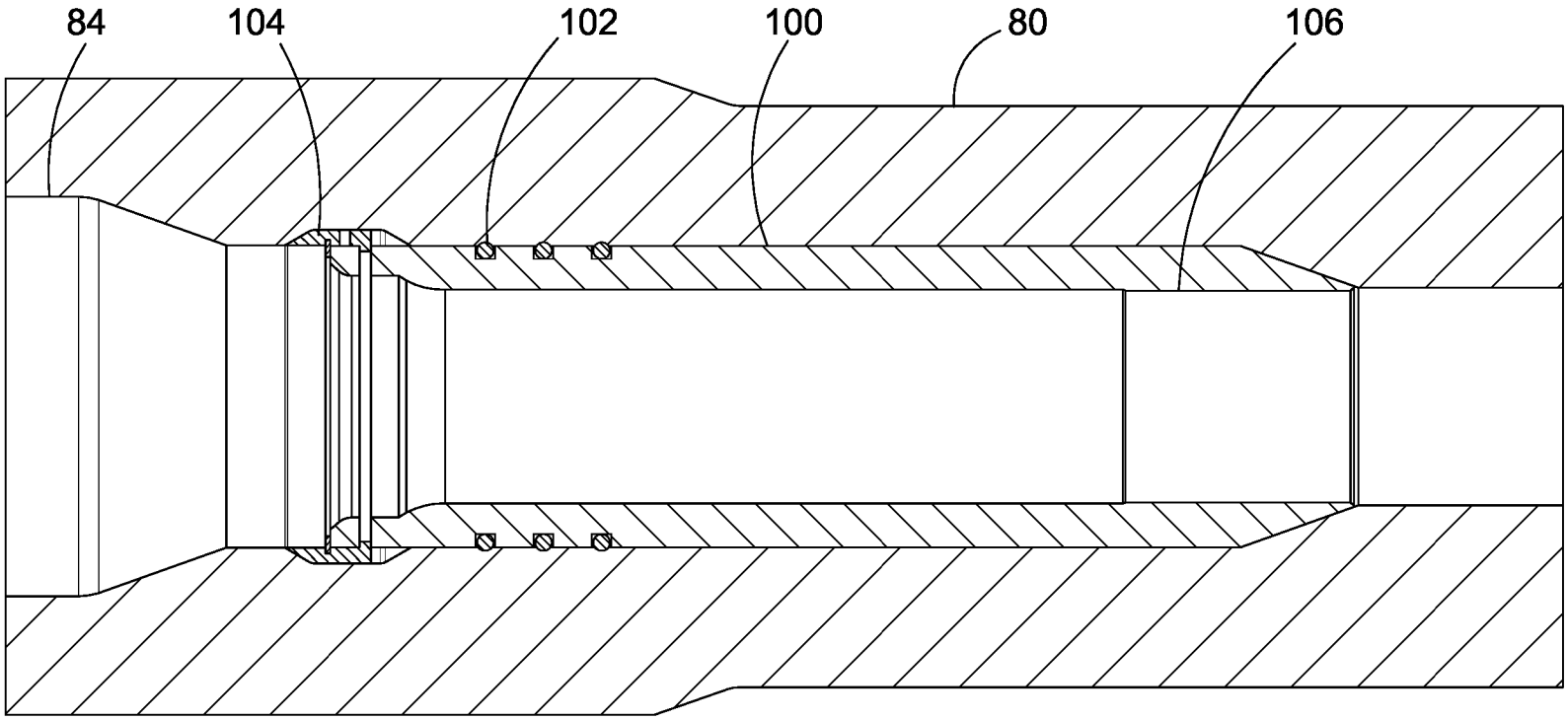
FIG. 10 is an enlarged view of an upper portion of the sub of FIG. 9.
Figure 11:
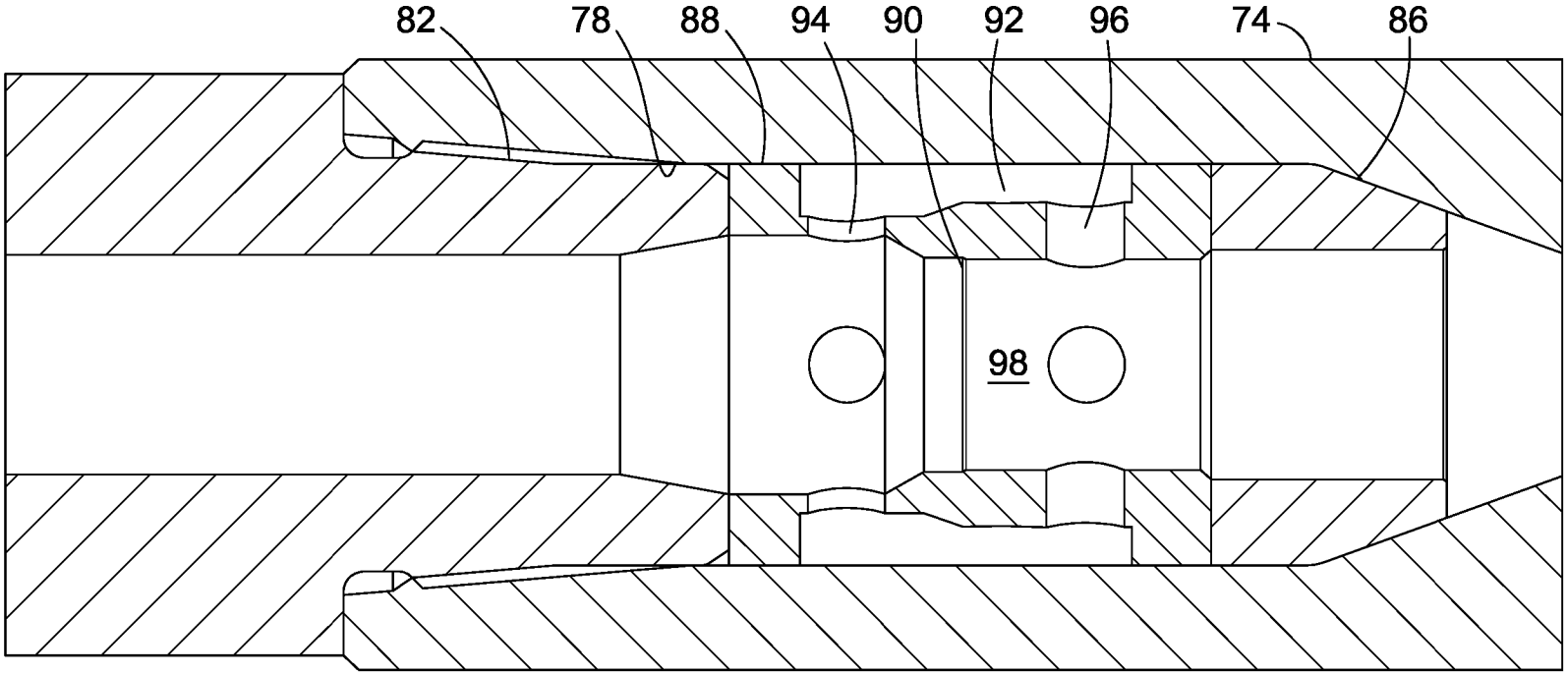
FIG. 11 is an enlarged view of a middle portion of the sub of FIG. 9.

Reference is now made to FIGS. 9 through 19 of the drawings, which illustrate an alternative cutter-locating drill string sub assembly 70 and pin-cutter dart 72. FIG. 9 is a sectional view of the two-part sub assembly 70, comprising tubular bottom and top subs 74, 80. The bottom sub 74 features a threaded leading pin 76, for connection to an adjacent part of the drill string (not shown) below the assembly 70, and a threaded trailing box 78. The top sub 80 features a threaded leading pin 82, for connection to the box 78, and a threaded trailing box 84 for connection to an adjacent part of the drill string (not shown) above the assembly 70. As will be described, the sub assembly 70 and dart 72 cooperate to allow an operator to sever the assembly 70 at the neck 85 of the top sub pin 82.

It will be noted that the subs 74, 80 have substantially solid walls and will be physically robust and structurally compatible with conventional drill string sections, capable of withstanding torque, tension and compression. Thus, the subs 74, 80 may be incorporated at any suitable location in a drill string, for example towards the lower end of a BHA.

The bottom sub 74 features an extended box 78 (FIG. 11) to accommodate a leading frusto-conical insert 86 and a bypass insert 88 which defines a seat 90 for a profile 91 on the nose 93 of the dart 72. The outer wall of the insert 88 is recessed to form an annular passage 92 between the insert 88 and the box 78, and radial bores 94, 96 to either side of the seat 90 provide for fluid communication around the seat 90 between the insert bore 98 and the passage 92. The inserts 86, 88 are retained in the box 78 by the top sub pin 82.

The top sub box 84 (FIG. 10) is bored back to accommodate a seal sleeve 100 which carries external seals 102 and is retained in the sub 80 by a split ring retainer 104. The inside leading end of the sleeve 100 defines a sealing bore 106 to cooperate with a seal 108 on the tail 110 of the dart 72.

Figure 12:
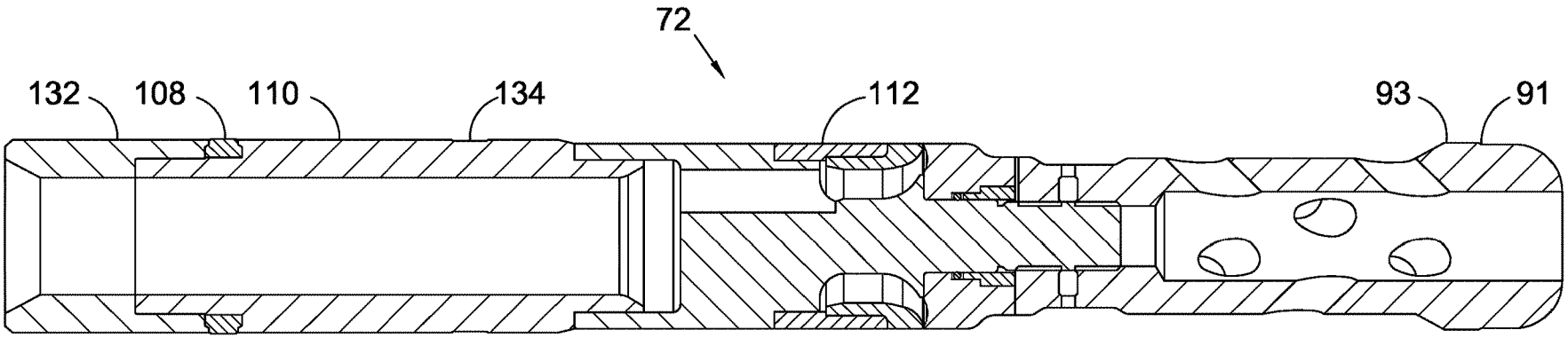
FIG. 12 is a sectional view of a pin-cutter dart in accordance with an alternative embodiment.
Figure 13:
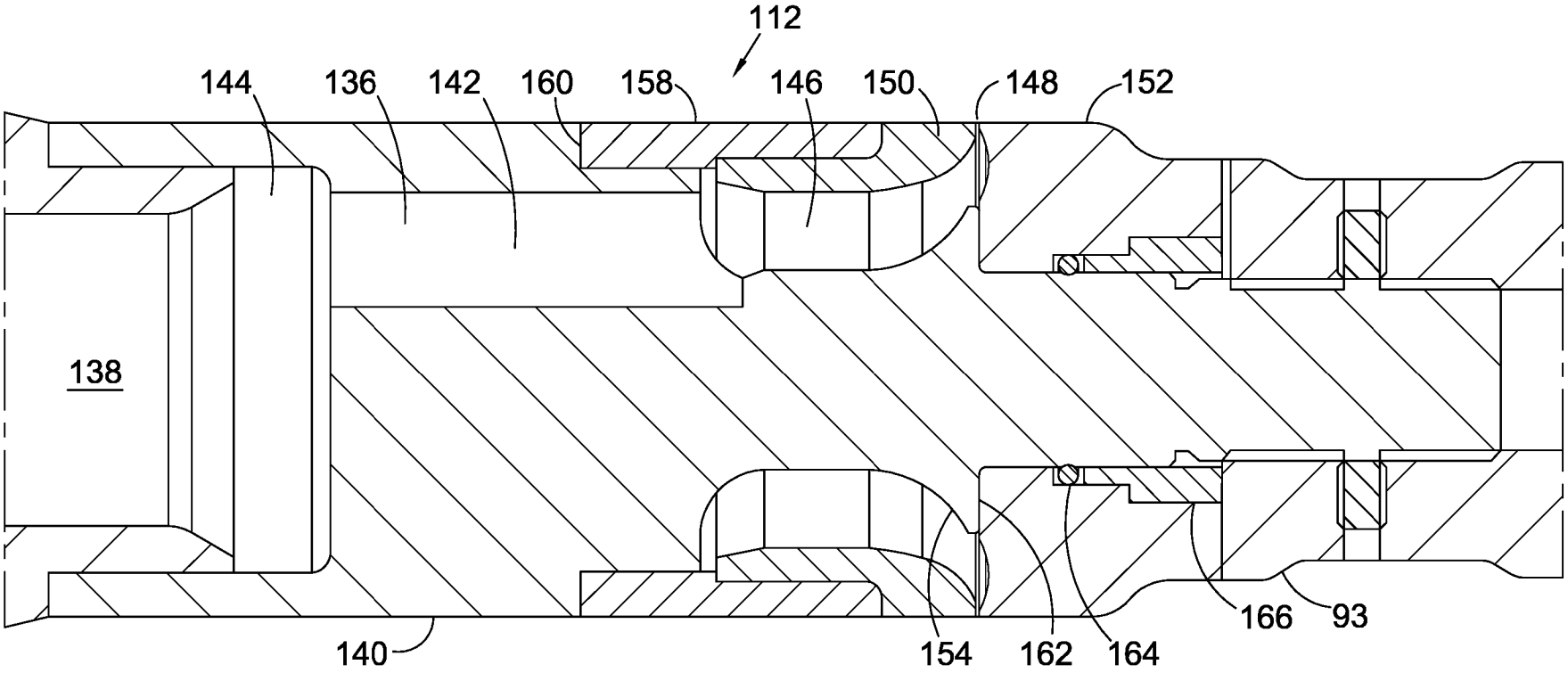
FIG. 13 is an enlarged view of a middle portion of the dart of FIG. 12.

A sectional view of the dart 72 is shown in FIG. 12, the dart comprising a locating and stabilising nose 93, a middle fluid-cutter portion 112, and a sealing and stabilising tail 110.

The dart nose 93 (see FIG. 14) has a bulbous end portion 114 of slightly smaller outer diameter than the inner diameter of the bypass insert 88, and defines the profile 91 for engaging the insert seat 90. The seat 90 thus acts as a no-go and axial support for the dart 72, while the cylindrical dart surfaces above and below the profile 91 cooperate with the corresponding insert surfaces above and below the seat 90 to stabilise the lower end of the dart.

The nose 93 defines a central bore 123 and has an open lower end 124. The upper end of the bore 123 defines an internal thread 126 for engaging the dart middle portion 112, with grub screws 128 locking the nose 93 and middle portion 112 against relative rotation. Radial passages 130 provide fluid communication between the upper outer surface of the nose and the bore 123, allowing further fluid bypass through the nose 93 when the dart 72 is seated in the insert 88.

The dart tail 110 is of relatively simple construction, comprising two press-fitted cylindrical parts 132, 134 with stepped ends and the seal 108 trapped therebetween. The spacing between the nose profile 91 and the seal 108 is determined to locate the seal 108 in the seal sleeve sealing bore 106 when the dart 72 lands in the sub assembly 70. The upper end of the tail 110 is of only slightly smaller diameter than the inner diameter of the surrounding seal sleeve, and thus serves to stabilise the upper end of the dart 72 in the sub assembly 70.

The dart middle fluid-cutter portion 112 is an assembly and defines a flow path 136 in communication with the dart tail bore 138. The bulk of the flow path 136 is defined by a metal body or annuliser 140. Five axial bores 142 extend through the body 140 from a short cylindrical manifold 144 and into a flared annular chamber 146. An inner wall of the chamber 146 is defined by the body 140, while an outer wall and a chamber outlet 148 are defined by a ceramic sleeve 150 and a ceramic diverter 152. The erosion-resistance of the metal body 140 is enhanced by a tungsten carbide coating 154.

The chamber 146 is configured to turn the flow of fluid from the axial flow exiting the bores 142 to a radial flow when the fluid exits the chamber 146 at the circumferential constriction defined between the opposing outer faces of the sleeve 150 and diverter 152 which form the outlet 148. The chamber also reduces in cross-section to a minimum at the outlet 148, such that the fluid is accelerated as it passes through the chamber 146, reaching a maximum speed at the outlet 148.

The ceramic sleeve 150 is retained and positioned by an external metal sleeve 158 which is press-fit on the body 140. The size of the constriction 148 may be varied by shimming the sleeve end face 160, and thus moving the sleeve 150 axially relative to the diverter 152. Alternatively, the size of the constriction 148 may be controlled by shimming an annular body shoulder 162. For example, the dart 72 may be supplied to an operator with a 0.045 inch shim or washer between the body shoulder 162 and the diverter 152 to provide a 0.045 inch gap at the constriction 148. However, the dart supplier may also provide a selection of other shims, for example a range of shims which vary in size by 0.005 inches. Depending on the hydraulics of the string and the mud circulation equipment, and the size of particulates circulating in the drilling fluid, the operator may choose to use one of the other shims to provide a larger or smaller gap. The operator thus has the ability to select the size of constriction 148 prior to positioning the dart 72 downhole.

The diverter 152 is retained between the annular body shoulder 162 and the upper end of the nose 93. An O-ring seal 164 is provided on an internal diameter of the diverter 152 in engagement with the body 140 and is retained in position by a stepped sleeve 166.

In use, in the event of the string becoming stuck and the decision being taken to sever the string, the operator will select the most appropriate location to sever the string and will also determine whether the circulation rate of fluid through the string is sufficient for a cutting operation. As noted above with reference to the first-described embodiment, several cutter-locating subs 70 may have been provided at different locations in and adjacent the BHA. Each sub 70 will include a seat 90 dimensioned to cooperate with a selected dart profile 91, the upper subs permitting darts with smaller profiles 91 to pass through the subs and land in a lower sub. The operator will usually select a dart 72 which will land on the sub 70 which is directly above the stuck-point. The operator will also likely open a bypass valve below the chosen sub 70, to ensure that fluid may circulate relatively freely down through the string and back up the annulus between the string and the bore wall.

The sequential opening of bypass valves may also be used to assist in identifying the location of the stuck point. In particular, the ability to flow through a bypass valve may be used as an indicator of whether a packed-off drill string is stuck above the bypass valve location: if an operator follows the procedures required to open the lowest bypass valve in the string and this does not result in restoration of circulation, this indicates that the string is packed-off, and also stuck, above the bypass valve. This process is repeated for each bypass valve. If opening of a bypass valve restores circulation, this indicates that the string is not packed-off above the valve and the free point is located below the valve. Thus, the operator may then locate and actuate the dart 72 directly above the valve.

Once the bypass valve has been opened, the appropriate dart 72 is pumped down through the string to land in the appropriate sub 70. The dart 72 will pass through the sub 70 until the nose profile 91 engages the seat 90 as illustrated, for example, in FIG. 14 of the drawings. The dart nose 93 is a close fit with the insert 88 and thus lateral as well as axial movement is restricted.

Figure 15:
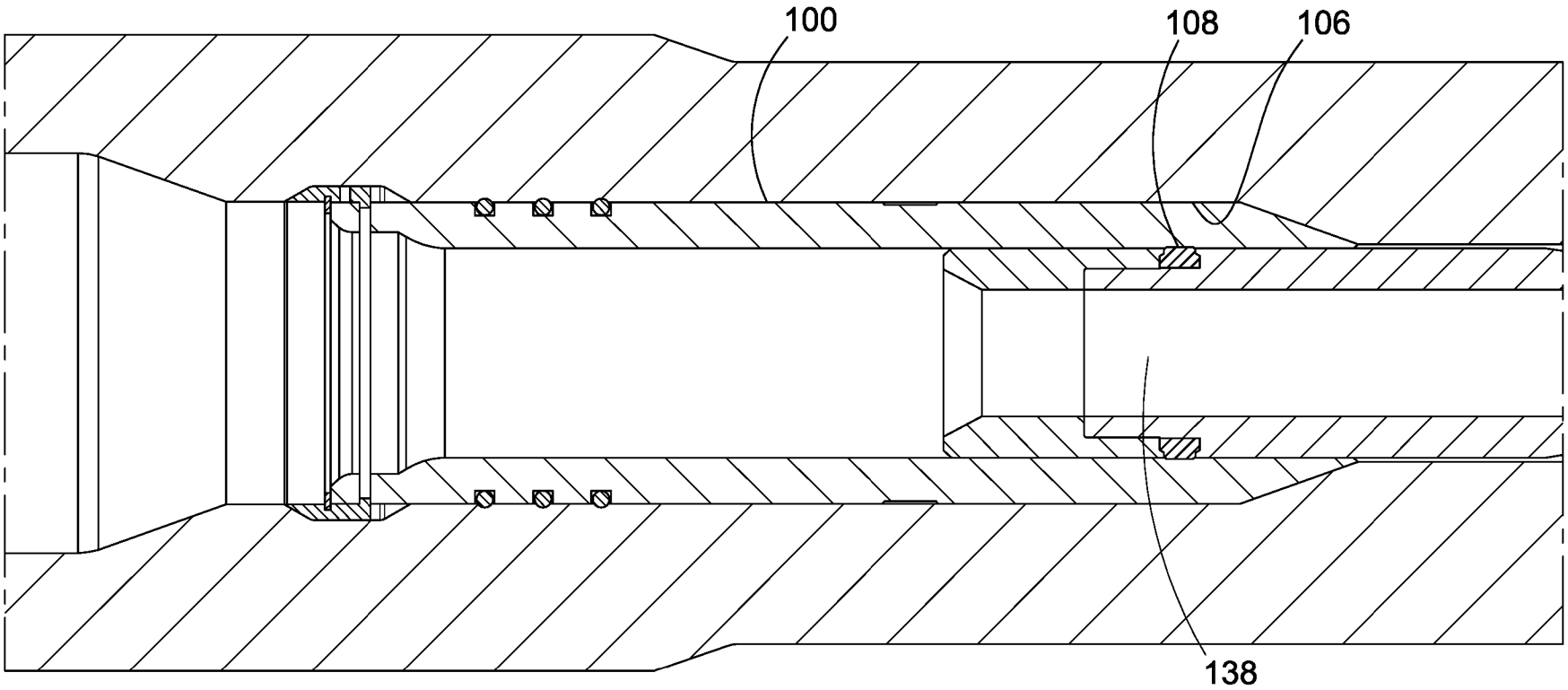
FIG. 15 shows the upper portion of the sub of FIG. 9 with the pin-cutter dart of FIG. 12 landed in the sub.

At the upper end of the dart 72, the seal 108 is positioned in the seal sleeve sealing bore 106, as illustrated in FIG. 15 of the drawings. As with the nose 93 in the insert 88, the upper end of the tail 110 is a close fit in the seal sleeve 100, and thus serves to stabilise the upper end of the dart against lateral movement.

Figure 14:
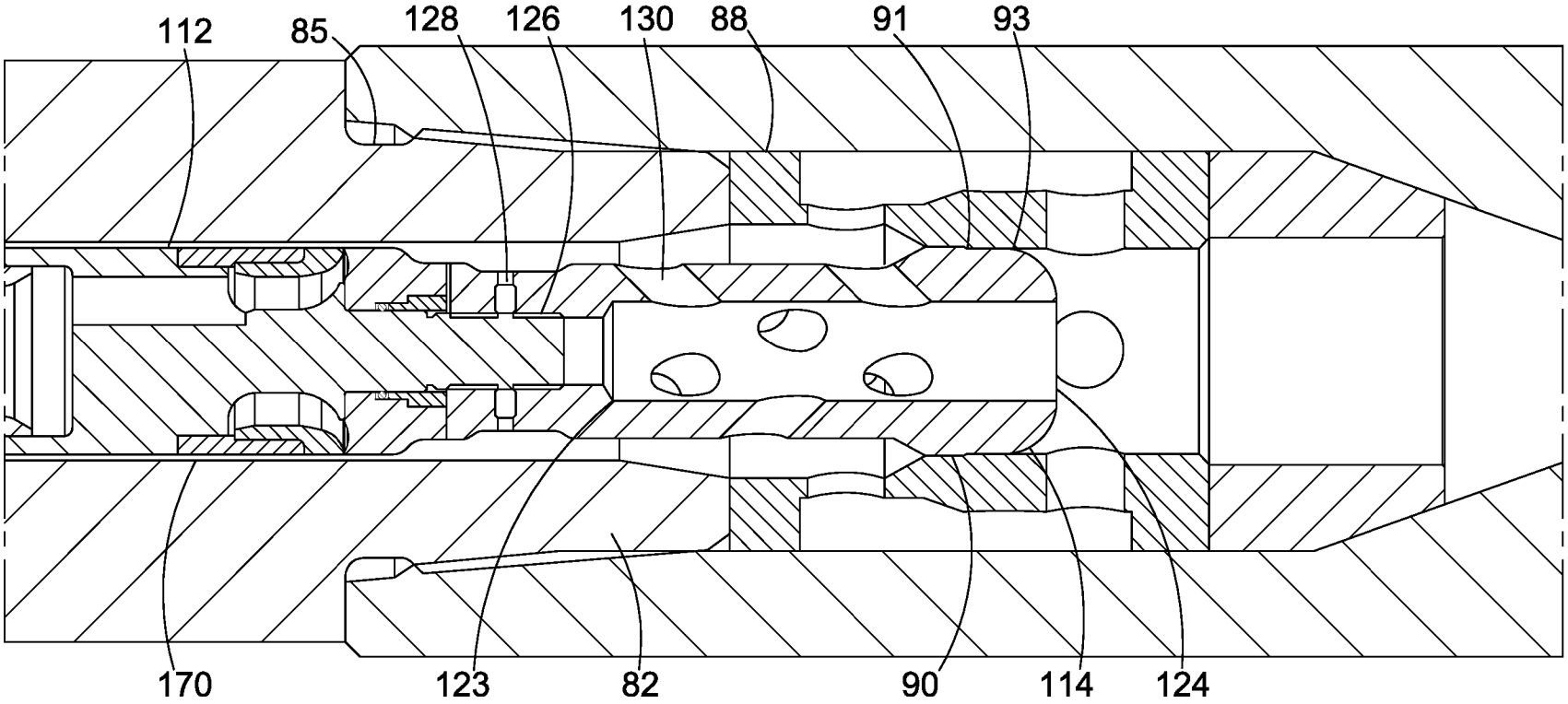
FIG. 14 shows the middle portion of the sub of FIG. 9 with the pin-cutter dart of FIG. 12 landed in the sub.

The dart middle portion 112 is positioned within the sub 70 such that the flow outlet and constriction 148 is aligned with the neck 85 of the top sub pin 82, as shown in FIG. 14.

The operator now turns up the surface pumps. At the BHA all of the fluid flow is directed into the upper end of the dart 72. The fluid flows down through the dart tail bore 138 and then follows the flow path 136, passing through the axial bores 142 and the chamber 146 to exit the dart 72 radially through the outlet 148. At exit from the dart 72, the fluid defines a high speed circumferentially-continuous stream and impinges on the inner surface of the pin 82. As the dart/sub annulus 170 above the pin 82 is closed-off by the seal 108, the fluid then flows downwards towards the dart nose 93.

The fluid may bypass the engaged nose profile 91 and seat 90 by flowing through the insert bores 94, 96 and passage 92, and through the nose passages 130 and central bore 123. The fluid will then pass down through the string and exit the string through the opened bypass valve, before circulating back to surface through the annulus between the string and the bore wall.

Figure 16:
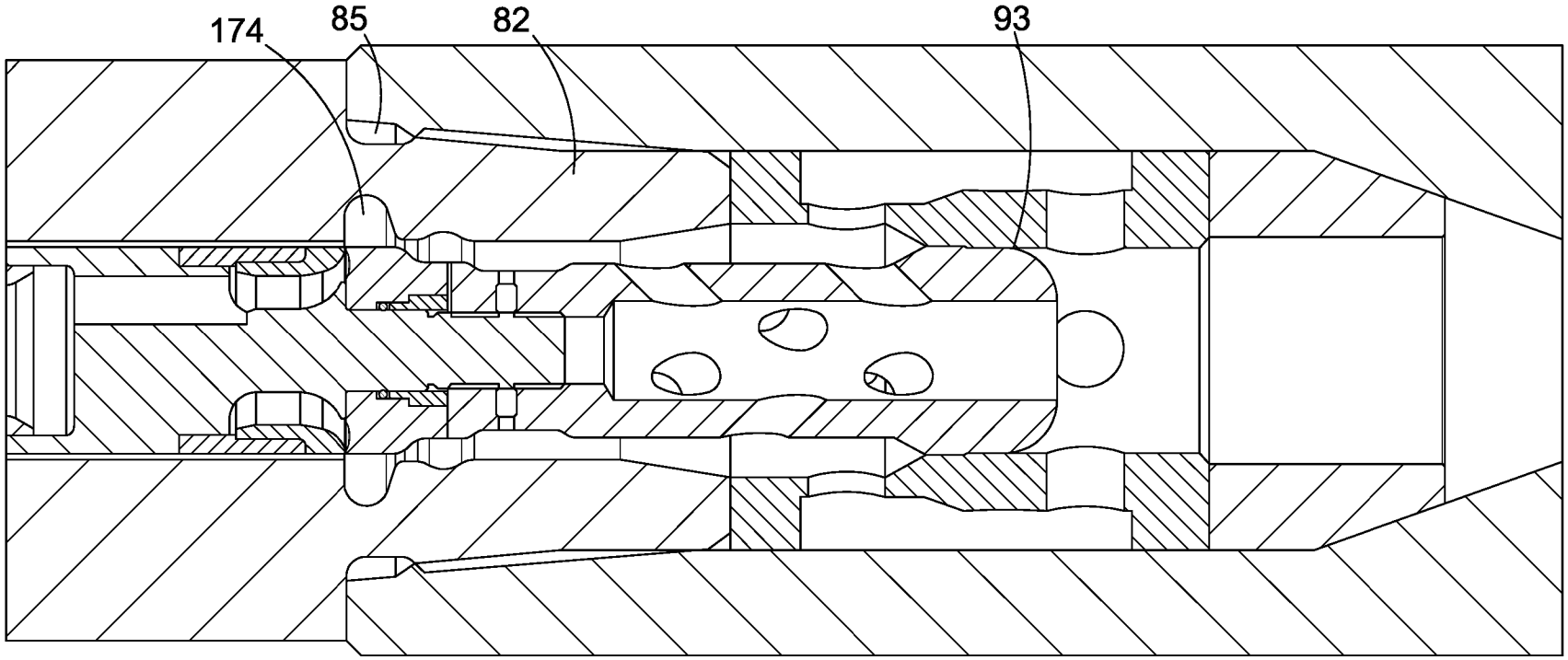
FIG. 16 corresponds to FIG. 14 and illustrates the progression of erosion of the neck of the pin of the sub.
Figure 17:
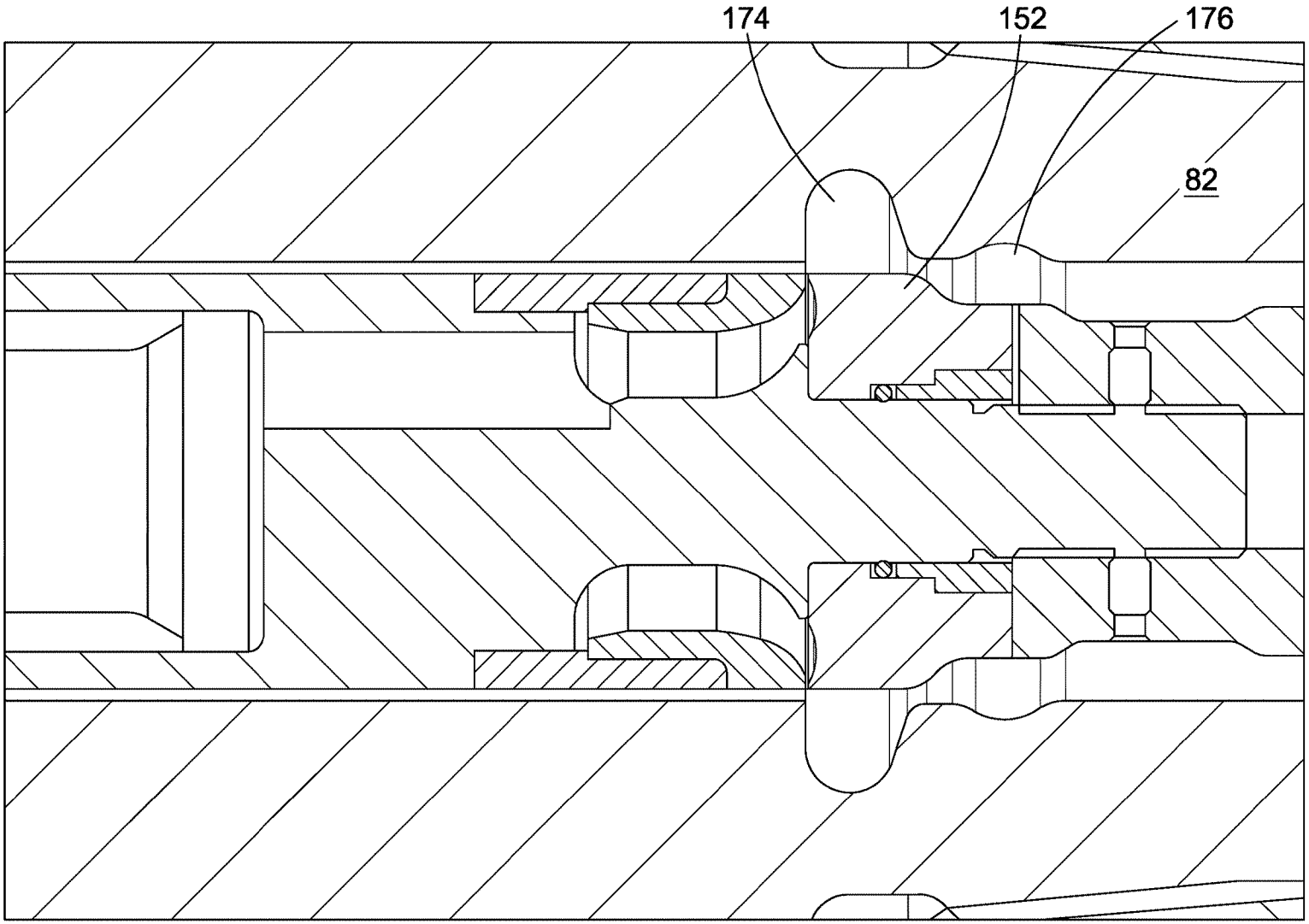
FIG. 17 is an enlarged view of the area around the neck of the sub of FIG. 16.

The high speed fluid impinging on the pin 82 will erode material from the pin inner surface, reducing the metal thickness and creating a recess 174 as illustrated in FIGS. 16 and 17. The fluid is deflected inwards by the pin surface and at this point still possesses significant energy. To minimise or prevent erosion of the dart the outer surface of the ceramic diverter 152 is stepped inwardly. However, in testing the erosive power of the fluid is still sufficient to then create a secondary recess 176 in the pin 82 below the primary recess 174.

The flow of fluid through the dart 72 may be maintained until the recess 174 extends through the pin 82, and the sub assembly 70 parts at the neck 85. However, it is normally the case that the operator will be simultaneously applying one or both of torque and tension to the string. Thus, as the recess 174 grows and the pin 82 weakens, the pin 82 will likely fail once the recess 174 has extended only part-way through the pin 82.

The hydraulic forces experienced by the dart 72 during the cutting operation are significant, and when coupled with vibration these conditions present an elevated risk of fatigue failure of dart components. However, vibration and movement are minimised by stabilising the upper and lower ends of the dart 72, while axially supporting the dart 72 at the nose 93 places a number of the most highly-stressed components in compression, reducing the likelihood of component failure.

Figure 18:
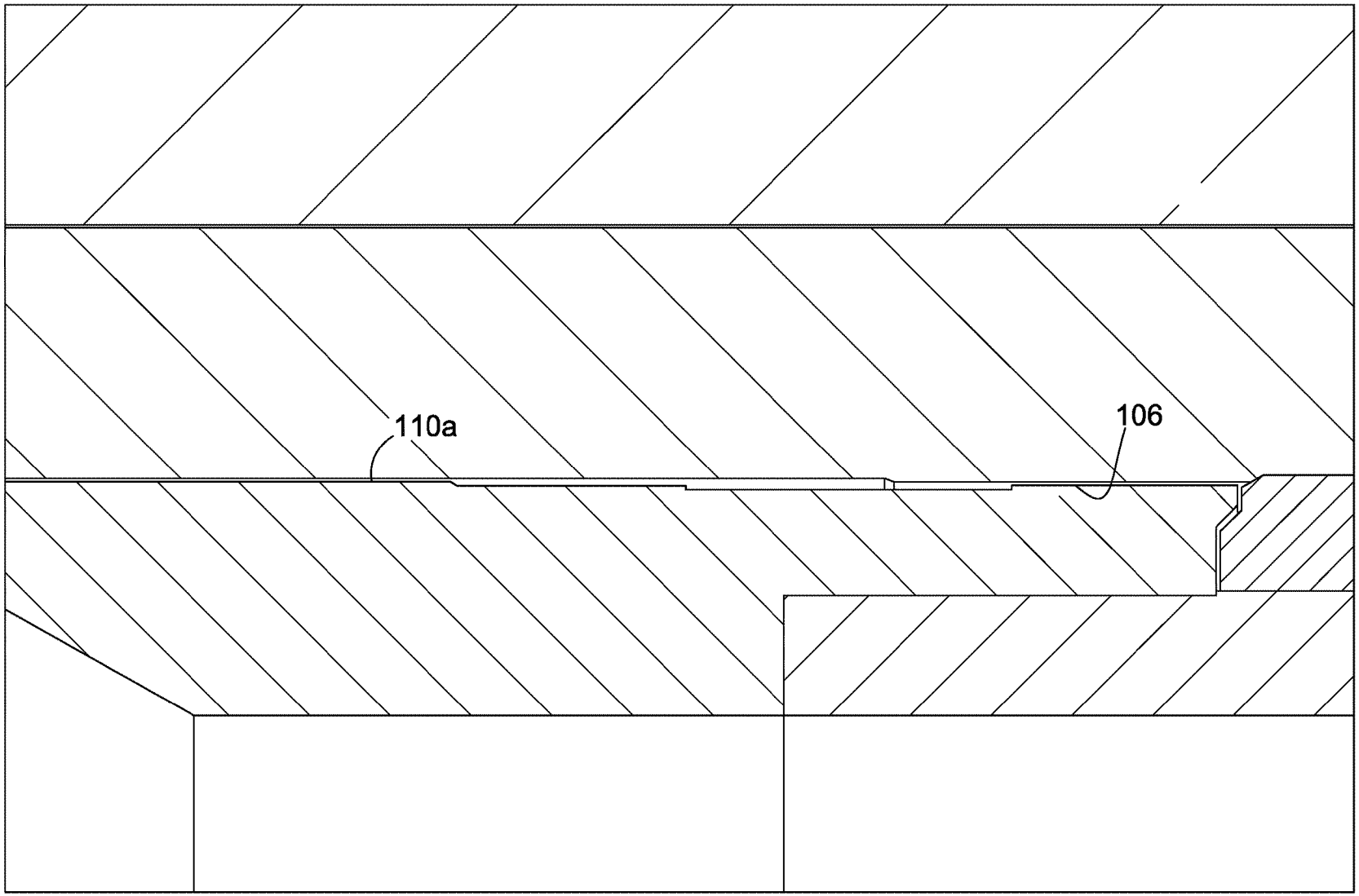
FIG. 18 is an enlarged view of the interaction between the upper portion of the sub of FIG. 9 and an upper portion of a pin-cutter dart intended to be retrieved with the upper part of the cut sub.

Once the pin 82 has parted, the string may be retrieved from the bore, leaving the BHA behind. In certain circumstances the operator may have decided to take further steps to attempt to retrieve or fish the BHA. In such a case, it is preferable to retrieve the dart 72 together with the string, and to this end the outer diameter of the upper end of the dart tail 110*a* is sized to be slightly larger than the inner diameter of the sealing bore 106, as illustrated in FIG. 18 of the drawings. This results in the dart 72 being retrieved from the bottom sub 74 with the string, leaving the upper end of the sub 74 available to be engaged by a fishing tool.

The upper end of the sub 74 is defined by the box 78 and the severed threaded portion of the top sub pin 82. The box 78 will be undamaged will provide a robust and predictable form to be engaged by a grapple or fishing tool.

Figure 19:
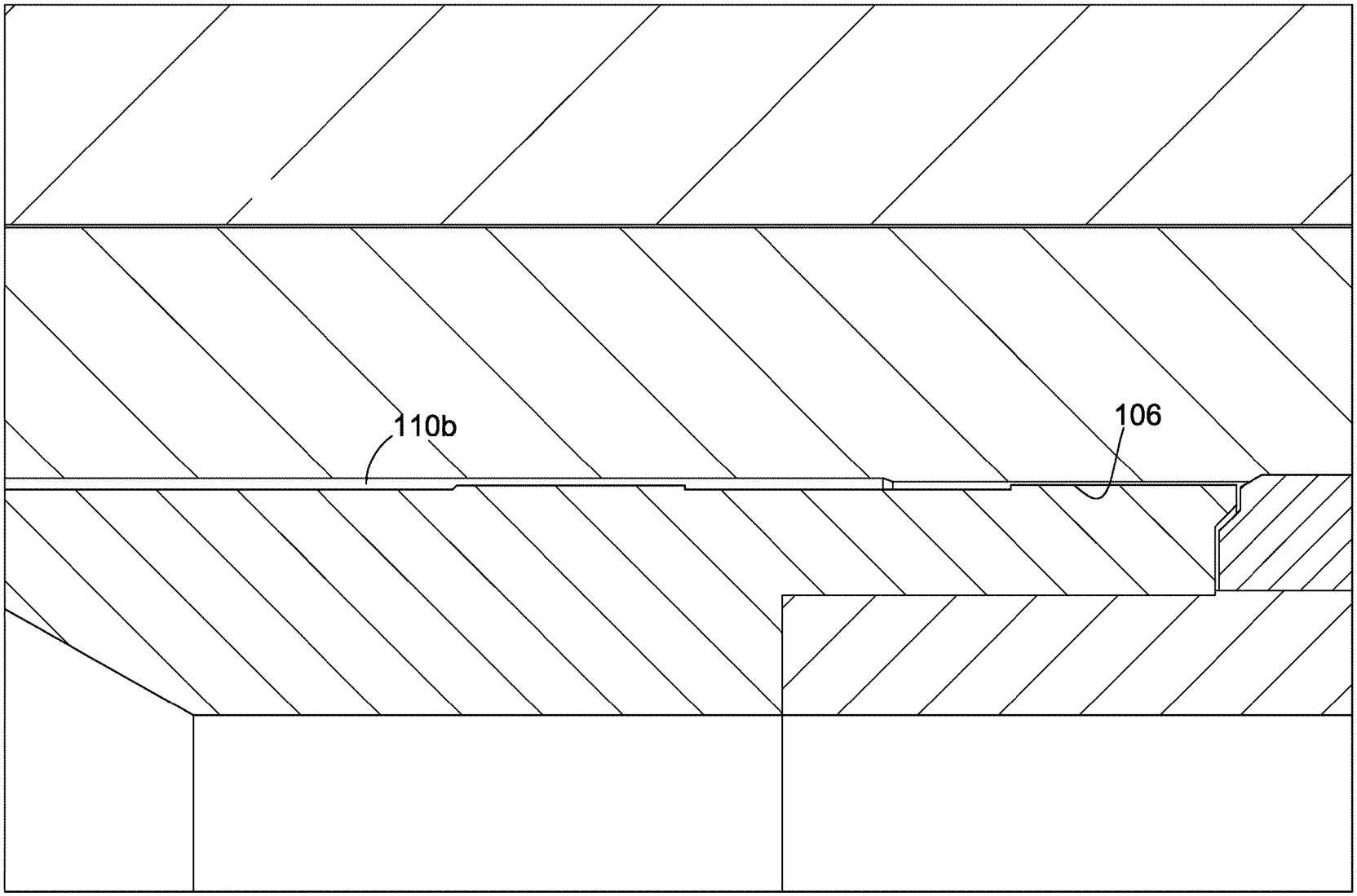
FIG. 19 is an enlarged view of the interaction between the upper portion of the sub of FIG. 9 and an upper portion of a pin-cutter dart intended to be left behind on retrieval of the upper part of the cut sub.

However, if it has been decided to leave the stuck BHA in the hole, it is preferable if the dart 72 drops out of the cut end of the string. This is achieved by sizing the outer diameter of the upper end of the dart tail 110*b* to be slightly smaller than the inner diameter of the sealing bore 106, as illustrated in FIG. 19 of the drawings. The severed string may be then be lifted clear of the BHA, and cement pumped down through the string to set a balance cement plug, that is a plug of cement in which the level of cement in the string bore and the surrounding annulus is equal. The string is then pulled out of the bore, leaving the cement plug to set. The operator will subsequently continue the bore by drilling around the plug and the stuck BHA.

Figure 20:
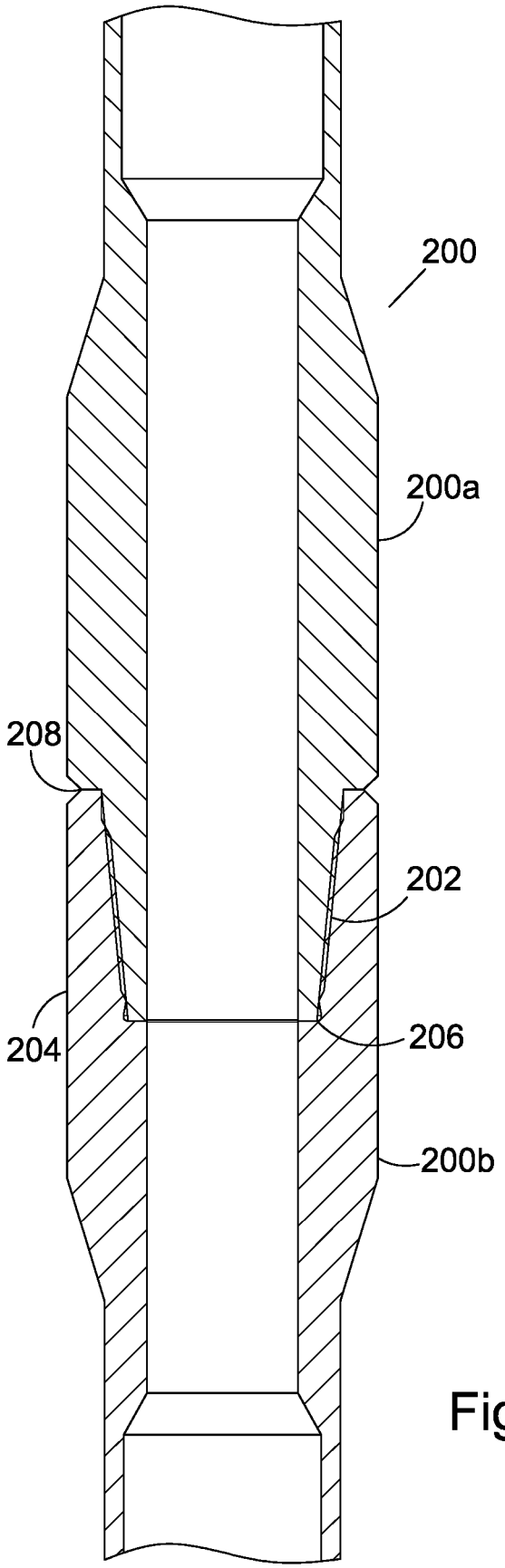
FIG. 20 is a schematic illustration of a double shouldered drill pipe connection.
Figure 21:
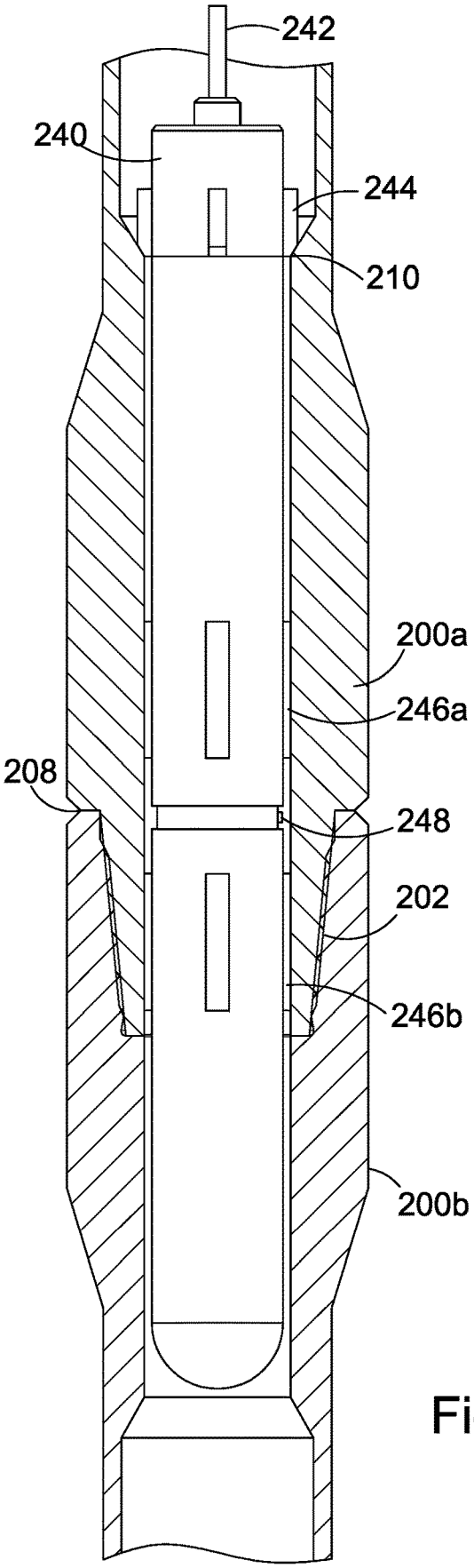
FIG. 21 is a schematic illustration of a wireline-mounted cutter positioned in the connection of FIG. 20.
Figure 22:
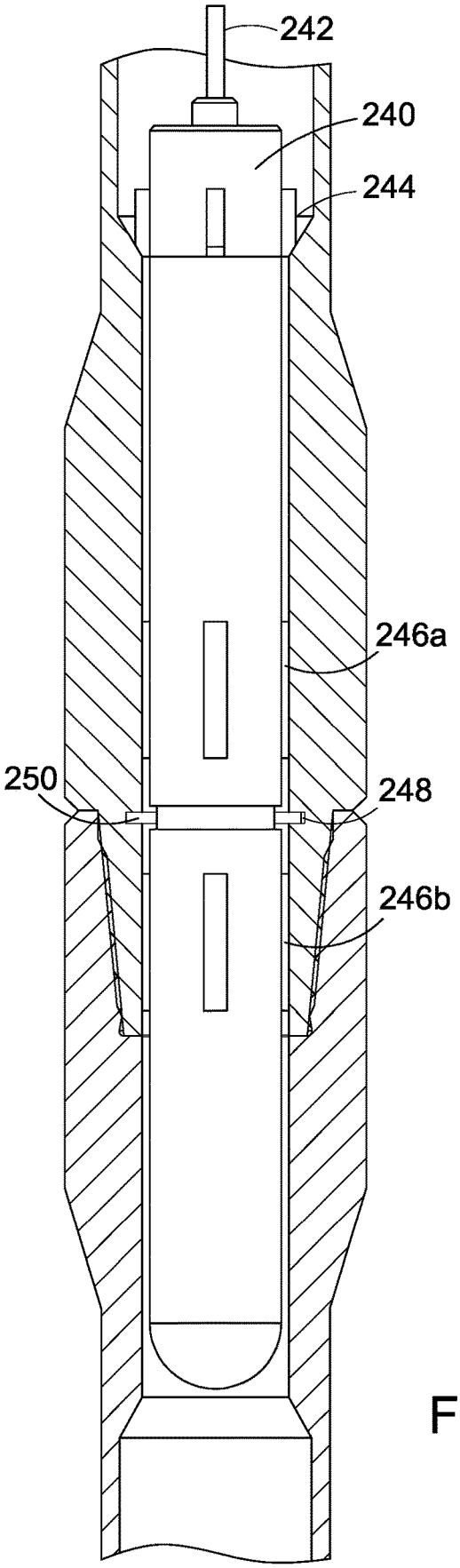
FIG. 22 is a schematic illustration of the cutter of FIG. 21 with a cutting blade extended.

Reference is now made to FIGS. 20 to 22 which illustrate use of a cutter of the present disclosure configured to be run in hole on an electric wireline. FIG. 20 shows a 5" double shouldered drill pipe connection 200. The upper part of the drill pipe connection 200*a* Includes a lower pin connection 202 which engages with an upper box connection 204 on the lower part of the drill pipe connection 200*b*. The end of the pin 202 engages an opposing shoulder 206 at the base of the box 204, and the end of the box 204 engages an opposing shoulder 208 at the base of the pin 202.

The cutter 240 is illustrated in FIG. 21, having been run into the drill string 200 on electric wireline 242. Unlike the other illustrated embodiments, the cutter utilises mechanical cutting blades 248 and further the location of this cutter 240 in the string is not reliant on the cutter 240 landing on a profile or seat. Rather, the use of the wireline allows the cutter 240 to be run into any desired depth, and the cutter 240 is then actuated to precisely locate and secure the cutter 240 at a selected connection.

The cutter 240 comprises a generally cylindrical body provided with three sets of initially retracted dogs which may be extended to engage the inner surface of the drill string 200. Once the cutter 240 has been run in to the desired depth, four upper dogs 244 are extended to engage with a shoulder 210 in the upper part 200*a* of the connection 200, which locates the cutting blade 248 precisely aligned with the root or neck of the pin 202, directly below the shoulder 208. The cutter 240 further comprises two sets of four gripping dogs 246; one set 246*a* is positioned above the cutting point and the second set 246*b* is positioned below. The gripping dogs 246 bear against the inner wall of the connection 200, retain the cutting tool 240 centrally within the drill string 200, and resist rotation of the cutter body.

FIG. 22 illustrates the cutting blades 248 of the cutting tool 240 in an extended position. The extension of the blades 248 is achieved by any appropriate mechanism, for example using cams. An electric motor provided within the cutter body rotates the extended blades 248 against the inner diameter of the pin neck, creating a circumferential cut or groove 250 as the cutting blades 248 remove material from the inner wall of the pin neck.

A pump within the tool body directs fluid towards the blades 248 to flush away swarf created by the cutting operation.

As with the other embodiments described above, the drill string, and thus the drill string connection 200, may be torqued or tension may be applied to the drill sting as the cutting tool 240 is rotated to aid in the shearing of the string at the neck of the pin.

If desired, the cutter 240 may be run into the drill string together with a free point indicator; the free point indicator will be mounted on the same electric wireline as the cutter 240. Accordingly, immediately the free point of the string has been identified, the cutter 240 can be positioned in the connection directly above the free point and activated to cut the string.

The skilled person will realise that the above described and illustrated embodiments are merely exemplary of implementations of the present disclosure and that various improvements and modifications may be made thereto, without departing from the scope of the disclosure. For example, it will be apparent that the particular dimensions and configuration of the illustrated subs and darts are not essential to the operation of the disclosure.

The invention claimed is:

1. A method of severing a drill pipe string, the method comprising the steps of:

dropping or pumping a flow-actuated cutter into the drill pipe string;

landing the cutter at a predetermined location in the string;

pumping cutting fluid down through the drill pipe string and through a flow passage in the cutter defining at least one of a constriction and a nozzle to provide a high velocity outlet stream from the cutter and remove material from a selected portion of the drill pipe string;

pumping the cutting fluid from a surface location down through an internal bore defined by the drill pipe string and through the cutter to remove material from the selected portion of a wall of the drill string;

directing the cutting fluid from the drill pipe string bore into an annulus between the drill pipe string and a surrounding bore wall, and returning the cutting fluid to the surface.

2. The method of claim 1, further comprising the step of applying torque or tension to the string.

3. The method of claim 1, further comprising severing the drill pipe string and then delivering cement through the severed string to form a kick-off plug.

4. The method of claim 1, wherein the selected portion is the neck of a drill pipe connection and wherein removing material further comprises the step of reducing the load-bearing cross-sectional area of the neck by forming a circumferential cut.

5. The method of claim 4, wherein the cut is circumferentially continuous.

6. The method of claim 1, further comprising the step of:

pumping the cutting fluid from a surface location down through an internal bore defined by the drill pipe string and through the cutter to remove material from the selected portion of a wall of the drill pipe string; and directing the cutting fluid from the drill pipe string bore into an annulus between the drill pipe string and a surrounding bore wall, and returning the cutting fluid to the surface.

7. The method of claim 1, further comprising the step of providing a fluid bypass device in the string and opening the device to facilitate fluid circulation through the string.

8. The method of claim 7, further comprising the step of opening the fluid bypass device to bypass fluid pressure loss-inducing drill string elements below the bypass device.

9. The method of claim 7, further comprising the step of opening the fluid bypass device before activating the cutter.

10. The method of claim 1, wherein the high velocity outlet stream has a flow speed of at least 100 feet/second.

11. The method of claim 1, wherein the cutting fluid comprises drilling fluid.

12. The method of claim 1, further comprising the step of locating the flow passage outlet directly adjacent an inner surface of the drill string.

13. The method of claim 1, further comprising the step of directing fluid from the cutter at a transverse angle to an axis of the string.

14. The method of claim 1, further comprising the step of creating at least one of eddies and vortices in the cutting fluid exiting the cutter.

15. The method claim 1, further comprising the step of directing cutting fluid from the cutter in a continuous circumferential stream.

16. The method of claim 1, further comprising the step of sealing a body of the cutter to a wall of the string and directing all of the cutting fluid pumped down the string into the cutter.

17. The method of claim 1, further comprising the step of adding an abrasive material to the cutting fluid.

18. The method of claim 1, further comprising the step of filtering the cutting fluid to avoid larger particles reaching the cutter.

19. The method of claim 1, further comprising the step of landing the cutter in a cutter seat.

20. An apparatus for severing a drill pipe string, the apparatus comprising:

a flow-actuated cutter configured to be dropped or pumped into a drill pipe string and to land at a predetermined location in the string, and wherein circulating cutting fluid down through the drill pipe string actuates the cutter to remove material from a selected portion of the drill pipe string and wherein the cutter is configured such that the cutting fluid exits the cutter in a high velocity stream directed towards an inner surface of the string and the cutter defines at least one of a constriction and a nozzle to provide the high velocity stream at a flow passage outlet, in combination with a seal bore provided in the string and wherein an external seal is provided on a cutter body between a flow passage inlet and the flow passage outlet for cooperating with the seal bore such that all of the cutting fluid pumped down the string is directed into the cutter.

21. The apparatus of claim 20, further comprising a filter located in a fluid circulation path to prevent particles from reaching and blocking the cutter.

22. The apparatus of claim 20, in combination with a seat provided in the string and including a cutter locator.

23. The apparatus of claim 22, wherein the seat is provided by a catcher ring.

24. The apparatus of claim 23, wherein the ring includes external seals.

25. The apparatus of claim 23, wherein the ring is adapted for location in an upper part of a locating sub.

26. The apparatus of claim 22, wherein the seat is configured for location in a cutter locating sub.

27. The apparatus of claim 20, further comprising the seats being of progressively smaller diameters.

28. The apparatus of claim 20, further comprising a fluid bypass device for location in the string.

29. The apparatus of claim 28, wherein the bypass device is adapted for location below the intended severing location.

30. The apparatus of claim 28, wherein the bypass device is adapted for location above the intended severing location.

31. The apparatus of claim 20, wherein the flow passage outlet further comprises a flow gap of less than or equal to 0.060 inches.

32. The apparatus of claim 20, wherein portions of the flow passage are formed of an erosion resistant material.

33. The apparatus of claim 32, wherein portions of the flow passage are coated with a hard facing material.

34. The apparatus of claim 20, wherein a fluid outlet is configured to be directly adjacent an inner surface of the drill string.

35. The apparatus of claim 20, wherein the cutter is configured such that the cutting fluid exits the cutter at a transverse angle to an axis of the string.

36. The apparatus of claim 20, wherein the cutter is configured such that the fluid exits the cutter in a continuous circumferential stream.

37. The apparatus of claim 20, in combination with a seal bore provided in the string and wherein an external seal is provided on a cutter body between a flow passage inlet and the flow passage outlet for cooperating with the seal bore such that all of the cutting fluid pumped down the string is directed into the cutter.

38. A method of severing a drill string, the method comprising the steps of:

opening a bypass valve in a stuck string to bypass fluid pressure loss-inducing drill string elements below the bypass valve;

locating a flow-actuated cutter in the drill string; and circulating fluid through the drill string to actuate the cutter and remove material from a selected portion of the drill string.

39. The method of claim 38 further comprising the steps of:

pumping the fluid from surface down through an internal bore defined by the drill string and through the cutter to actuate the cutter and remove material from the selected portion of a wall of the drill string; directing the fluid from the drill string bore and through the open bypass valve into an annulus between the drill string and a surrounding bore wall, and returning the fluid to surface.

40. The method of claim 38, further comprising the step of severing the drill string into an upper portion and a lower portion.

41. The method of claim 40, wherein, once the pipe string has been severed, further comprising the step of delivering cement into the bore through the upper portion of the string to form a kick-off plug above the lower portion of the string that remains in the bore.

42. The method of claim 40, wherein, once the pipe string has been severed, further comprising the step of removing the lower portion of the string from the bore.

43. The method of claim 40, further comprising the step of removing at least one device from the lower portion of the string.

44. The method of claim 40, further comprising the steps of removing the upper portion of the string from the bore and running a further string run into the bore to at least one of engage and mate with the top of the lower section of the string that remains in the hole.

45. The method of claim 40, further comprising the step of passing wireline equipped with a fishing tool through the further string and into the lower section of the tool.

46. A method of severing a drill pipe string, the method comprising the steps of:

dropping or pumping a flow-actuated cutter into the drill pipe string;

landing the cutter at a predetermined location in the string;

pumping cutting fluid down through the drill pipe string and through a flow passage in the cutter defining at least one of a constriction and a nozzle to provide a high velocity outlet stream from the cutter and remove material from a selected portion of the drill pipe string; and wherein the selected portion of the drill pipe string is a neck of a drill pipe connection and wherein removing material further comprises the step of reducing the loadbearing cross-sectional area of the neck by forming a circumferential cut.

47. A method of severing a drill pipe string, the method comprising the steps of:

dropping or pumping a flow-actuated cutter into the drill pipe string;

landing the cutter at a predetermined location in the string;

pumping cutting fluid down through the drill pipe string and through a flow passage in the cutter defining at least one of a constriction and a nozzle to provide a high velocity outlet stream from the cutter and remove material from a selected portion of the drill pipe string;

providing the cutter with a constriction having a predetermined flow area and, prior to locating the cutter in the drill string, adjusting the size of the flow area with reference to at least one of: drill string hydraulics; fluid circulation equipment, and the size of particulates circulating in the fluid; and adjusting the size of the flow area by the provision of at least one shim in the cutter.

48. A method of severing a drill pipe string, the method comprising the steps of:

dropping or pumping a flow-actuated cutter into the drill pipe string;

landing the cutter at a predetermined location in the string;

pumping cutting fluid down through the drill pipe string and through a flow passage in the cutter defining at least one of a constriction and a nozzle to provide a high velocity outlet stream from the cutter and remove material from a selected portion of the drill pipe string;

providing a fluid bypass device in the string and opening the device to facilitate fluid circulation through the string; and opening the fluid bypass device to bypass fluid pressure loss-inducing drill string elements below the bypass device.

49. A method of severing a drill pipe string, the method comprising the steps of:

dropping or pumping a flow-actuated cutter into the drill pipe string;

landing the cutter at a predetermined location in the string;

pumping cutting fluid down through the drill pipe string and through a flow passage in the cutter defining at least one of a constriction and a nozzle to provide a high velocity outlet stream from the cutter and remove material from a selected portion of the drill pipe string;

providing a fluid bypass device in the string and opening the device to facilitate fluid circulation through the string; and opening the fluid bypass device to bypass a packet off section of annulus between the drill string and a surrounding bore wall.

50. A method of severing a drill pipe string, the method comprising the steps of:

dropping or pumping a flow-actuated cutter into the drill pipe string;

landing the cutter at a predetermined location in the string;

pumping cutting fluid down through the drill pipe string and through a flow passage in the cutter defining at least one of a constriction and a nozzle to provide a high velocity outlet stream from the cutter and remove material from a selected portion of the drill pipe string;

providing a fluid bypass device in the string and opening the device to facilitate fluid circulation through the string; and opening the fluid bypass device after the drill pipe string has been severed and then pumping cement through the string and through the open bypass device to form a kick-off plug.

51. A method of severing a drill pipe string, the method comprising the steps of:

dropping or pumping a flow-actuated cutter into the drill pipe string;

landing the cutter at a predetermined location in the string;

pumping cutting fluid down through the drill pipe string and through a flow passage in the cutter defining at least one of a constriction and a nozzle to provide a high velocity outlet stream from the cutter and remove material from a selected portion of the drill pipe string; and severing the string and at least one of: dropping the cutter out of the severed string, and opening a less restricted flow path through the string.

52. An apparatus for severing a drill pipe string, the apparatus comprising:

a flow-actuated cutter configured to be dropped or pumped into a drill pipe string and to land at a predetermined location in the string;

wherein circulating cutting fluid down through the drill pipe string actuates the cutter to remove material from a selected portion of the drill pipe string and wherein the cutter is configured such that the cutting fluid exits the cutter in a high velocity stream directed towards an inner surface of the string and the cutter defines at least one of a constriction and a nozzle to provide the high velocity stream at a flow passage outlet; and a plurality of seats provided in the string and cooperating with a cutter locator.

53. An apparatus for severing a drill pipe string, the apparatus comprising:

a flow-actuated cutter configured to be dropped or pumped into a drill pipe string and to land at a predetermined location in the string;

wherein circulating cutting fluid down through the drill pipe string actuates the cutter to remove material from a selected portion of the drill pipe string and wherein the cutter is configured such that the cutting fluid exits the cutter in a high velocity stream directed towards an inner surface of the string and the cutter defines at least one of a constriction and a nozzle to provide the high velocity stream at a flow passage outlet;

in combination with a seat provided in the string and including a cutter locator, a profile dimensioned to engage the seat, the cutter locator and the seat being configured to engage and form a seal therebetween.

54. An apparatus for severing a drill pipe string, the apparatus comprising:

a flow-actuated cutter configured to be dropped or pumped into a drill pipe string and to land at a predetermined location in the string;

wherein circulating cutting fluid down through the drill pipe string actuates the cutter to remove material from a selected portion of the drill pipe string and wherein the cutter is configured such that the cutting fluid exits the cutter in a high velocity stream directed towards an inner surface of the string and the cutter defines at least one of a constriction and a nozzle to provide the high velocity stream at a flow passage outlet; and a plurality of fluid bypass devices being provided for location in the drill sting, each associated with a particular severing location.

55. An apparatus for severing a drill pipe string, the apparatus comprising:

a flow-actuated cutter configured to be dropped or pumped into a drill pipe string and to land at a predetermined location in the string;

wherein circulating cutting fluid down through the drill pipe string actuates the cutter to remove material from a selected portion of the drill pipe string and wherein the cutter is configured such that the cutting fluid exits the cutter in a high velocity stream directed towards an inner surface of the string and the cutter defines at least one of a constriction and a nozzle to provide the high velocity stream at a flow passage outlet; and the cutter being reconfigurable to allow the cutter to either drop out of the severed string or to open a less restricted flow path through the string.

56. An apparatus for severing a drill pipe string, the apparatus comprising:

a flow-actuated cutter configured to be dropped or pumped into a drill pipe string and to land at a predetermined location in the string;

wherein circulating cutting fluid down through the drill pipe string actuates the cutter to remove material from a selected portion of the drill pipe string and wherein the cutter is configured such that the cutting fluid exits the cutter in a high velocity stream directed towards an inner surface of the string and the cutter defines at least one of a constriction and a nozzle to provide the high velocity stream at a flow passage outlet; and wherein the cutter further includes at least one shim and the flow passage outlet defines a flow area controlled by the at least one shim.

57. A method of severing a drill string, the method comprising the steps of:

opening a bypass valve in a stuck string to bypass a packed-off section of annulus between the drill string and a surrounding bore wall;

locating a flow-actuated cutter in the drill string; and circulating fluid through the drill string to actuate the cutter and remove material from a selected portion of the drill string.

* * * * *